US009440465B2

(12) United States Patent
Ogawa et al.

(10) Patent No.: US 9,440,465 B2
(45) Date of Patent: Sep. 13, 2016

(54) PRINTING APPARATUS, METHOD OF CONTROLLING THE SAME, AND STORAGE MEDIUM

(71) Applicant: CANON KABUSHIKI KAISHA, Tokyo (JP)

(72) Inventors: Katsuya Ogawa, Kawasaki (JP); Syunichi Kunihiro, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/743,039

(22) Filed: Jun. 18, 2015

(65) Prior Publication Data

US 2015/0375540 A1 Dec. 31, 2015

(30) Foreign Application Priority Data

Jun. 30, 2014 (JP) ..... 2014-135170

(51) Int. Cl.
*B41J 13/00* (2006.01)

(52) U.S. Cl.
CPC ..... *B41J 13/0018* (2013.01)

(58) Field of Classification Search
CPC .. B41J 13/00; B41J 13/0009; B41J 13/0018; B41J 13/0027; B41J 11/0055; B41J 11/008; B41J 11/0095; B41J 11/20; B41J 11/42; B41J 11/425; B41J 11/44; B41J 11/46; B41J 11/50; B41J 11/51
USPC ..... 347/16
See application file for complete search history.

(56) References Cited

U.S. PATENT DOCUMENTS 6,848,848 B2 * 2/2005 Terao ..... B41J 13/0018 400/624
2006/0055718 A1 * 3/2006 Endo ..... B41J 11/0095 347/14
2015/0251865 A1 9/2015 Nishida et al.
2015/0256694 A1 9/2015 Suzuki et al.

FOREIGN PATENT DOCUMENTS

JP 2000-015881 A 1/2000

OTHER PUBLICATIONS

Unpublished, copending U.S. Appl. No. 14/729,324 to Syunichi Kunihiro et al., filed Jun. 3, 2015.

(Continued)

*Primary Examiner* — Geoffrey Mruk
*Assistant Examiner* — Scott A Richmond
(74) *Attorney, Agent, or Firm* — Fitzpatrick, Cella, Harper & Scinto

(57) ABSTRACT

A printing apparatus includes: a printing unit having a plurality of printing elements arranged in a conveyance direction of the printing sheet and configured to print the printing sheet; a conveyance control unit configured to control conveyance of printing sheets so that a trailing edge of a preceding sheet as a printing sheet precedingly fed from the stacking unit and a leading edge of a succeeding sheet as a printing sheet fed after the preceding sheet overlap each other; a determination unit configured to determine, under a predetermined condition, whether to convey the succeeding sheet to a position facing the printing unit while keeping an overlap state between the preceding sheet and the succeeding sheet; and a printing control unit configured to control, based on a determination result of the determination unit, printing elements of the printing unit to be used.

12 Claims, 15 Drawing Sheets

(56) References Cited

OTHER PUBLICATIONS

Unpublished, copending U.S. Appl. No. 14/723,629 to Yasufumi Tanaami et al., filed May 28, 2015.
Unpublished, copending U.S. Appl. No. 14/723,617 to Hisashi Taniguchi et al., filed May 28, 2015.
Unpublished, copending U.S. Appl. No. 14/722,324 to Motoyuki Taguchi et al., filed May 27, 2015.
Unpublished, copending U.S. Appl. No. 14/722,379 to Tomofumi Nishida et al., filed May 27, 2015.
Unpublished, copending U.S. Appl. No. 14/715,810 to Tetsuya Saito et al., filed May 19, 2015.

* cited by examiner

PRINTING APPARATUS, METHOD OF CONTROLLING THE SAME, AND STORAGE MEDIUM

BACKGROUND OF THE INVENTION

1. Field of the Invention

The present invention relates to a printing apparatus for printing a sheet by a printhead and, more particularly, to a printing technique of conveying sheets to a printing area facing a printhead while part of a succeeding sheet overlaps part of a preceding sheet.

2. Description of the Related Art

Japanese Patent Laid-Open No. 2000-15881 describes a printing apparatus for controlling to make the marginal area of the leading edge of a succeeding sheet overlap the marginal area of the trailing edge of a preceding sheet, which comprises a feeding unit configured to separate and feed a plurality of sheets one by one, a printing unit configured to form an image on a sheet, a conveying unit configured to convey a sheet to the printing unit, a detection unit configured to detect a sheet, and a control unit configured to control driving of the feeding unit according to a signal of the detection unit.

However, the apparatus described in Japanese Patent Laid-Open No. 2000-15881 can start to feed the succeeding sheet only when the marginal amount of the trailing edge of the preceding sheet and that of the leading edge of the succeeding sheet are confirmed before the start of feeding of the succeeding sheet. This imposes a technical problem that it takes time to start to feed the succeeding sheet.

Even if the marginal amount of the trailing edge of the preceding sheet and that of the leading edge of the succeeding sheet are not confirmed, the preceding sheet and the succeeding sheet overlap each other regardless of the margins. Therefore, it is only necessary to include a determination unit configured to determine whether to convey the succeeding sheet to a position facing the printing unit while keeping an overlap state.

On the other hand, there is a printing apparatus in which the printing elements of a printhead are juxtaposed in the conveyance direction of a sheet, and which performs an image forming operation by moving the printhead in a direction perpendicular to the conveyance direction of the sheet. This printing apparatus forms an image on a sheet by a printing operation of repeating conveyance of the sheet and movement of the printhead under given conditions.

However, in the printing operation of repeating conveyance of the sheet and movement of the printhead under the given conditions, the determination unit may determine that predetermined conditions for keeping the overlap state are not satisfied. In this case, it is impossible to convey sheets while keeping the overlap state between a succeeding sheet and preceding sheet.

The present invention has been made in consideration of the above-described problem, and provides a printing technique capable of conveying printing sheets while keeping the overlap state by changing printing elements to be used so as to satisfy the predetermined conditions for keeping the overlap state.

SUMMARY OF THE INVENTION

According to one aspect of the present invention, there is provided a printing apparatus comprising: a feeding unit configured to feed a printing sheet stacked on a stacking unit; a conveying unit configured to convey the printing sheet fed by the feeding unit; a printing unit having a plurality of printing elements arranged in a conveyance direction of the printing sheet and configured to print the printing sheet; a conveyance control unit configured to control conveyance of printing sheets so that a trailing edge of a preceding sheet as a printing sheet precedingly fed from the stacking unit and a leading edge of a succeeding sheet as a printing sheet fed after the preceding sheet overlap each other; a determination unit configured to determine, under a predetermined condition, whether to convey the succeeding sheet to a position facing the printing unit while keeping an overlap state between the preceding sheet and the succeeding sheet; and a printing control unit configured to control, based on a determination result of the determination unit, printing elements of the printing unit to be used.

According to the present invention, it is possible to convey printing sheets while keeping the overlap state by changing printing elements to be used so as to satisfy the predetermined conditions for keeping the overlap state.

According to the present invention, it is possible to provide a printing technique which requires no time to start printing of a succeeding printing sheet.

Further features of the present invention will become apparent from the following description of exemplary embodiments (with reference to the attached drawings).

DESCRIPTION OF THE EMBODIMENTS

An embodiment of the present invention will be described in detail below with reference to the accompanying drawings.

Figure 1:
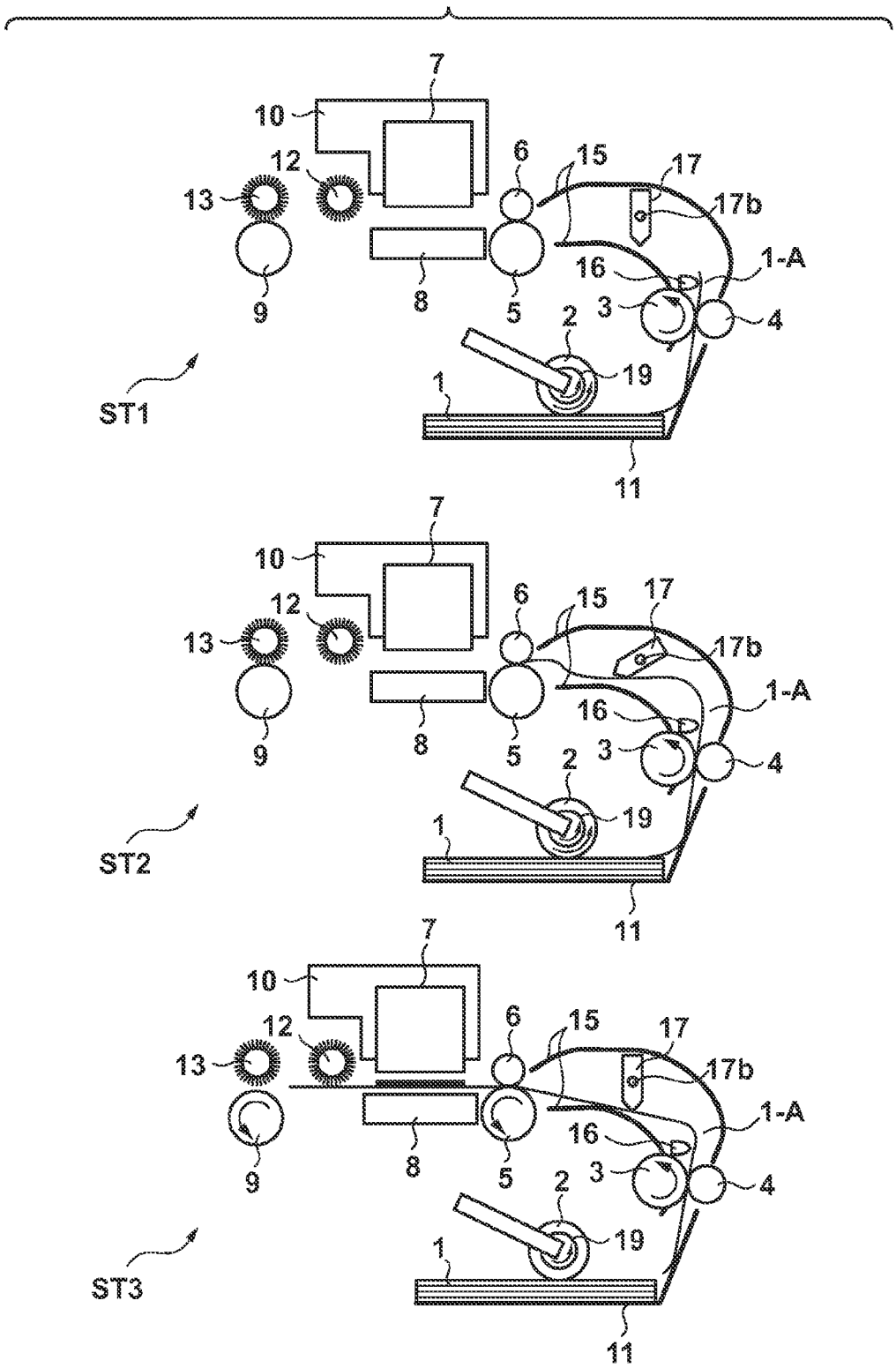
FIG. 1 is a view for explaining a successive overlapped conveyance operation in a printing apparatus according to an embodiment of the present invention.
Figure 2:
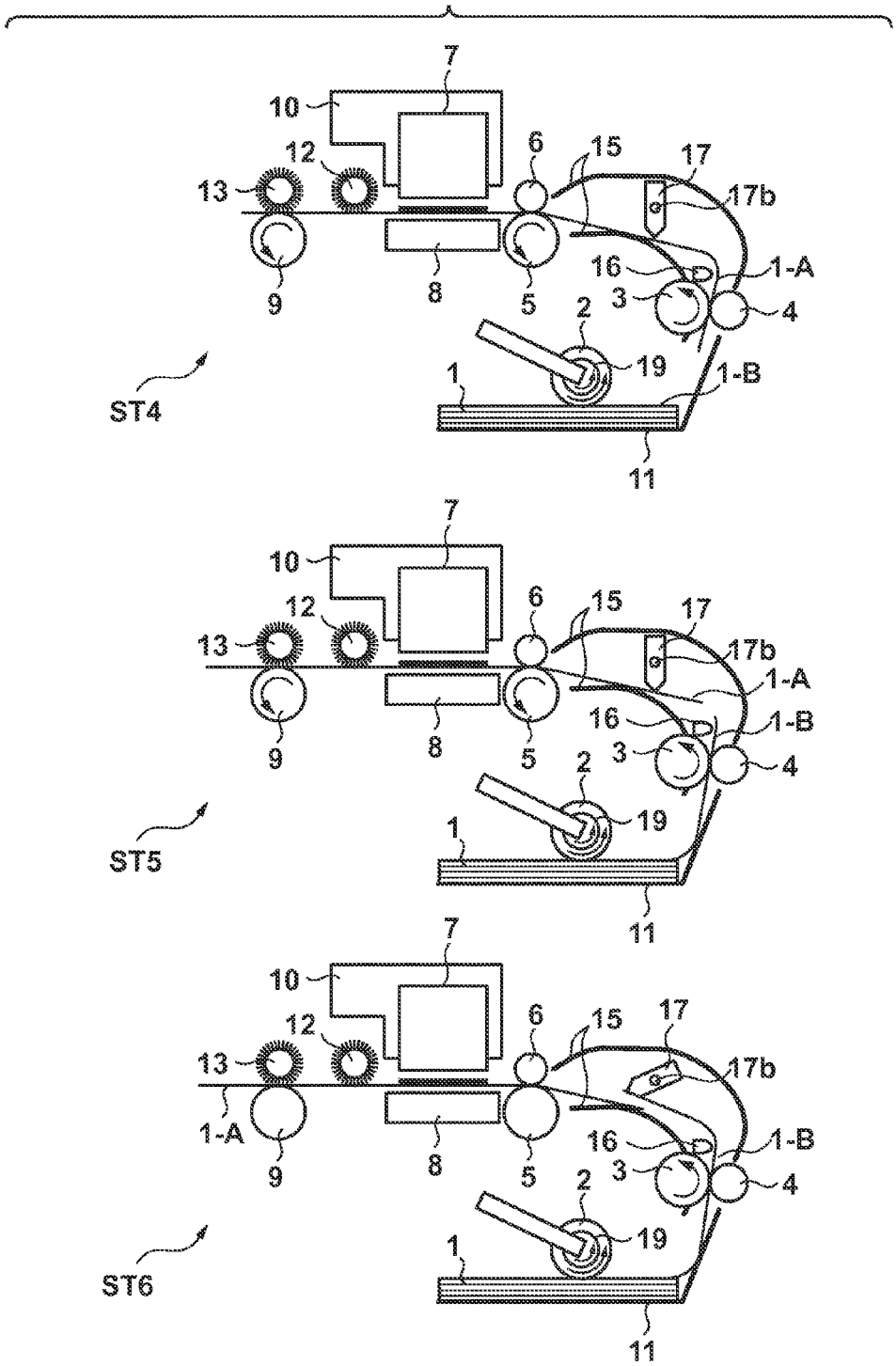
FIG. 2 is a view for explaining the successive overlapped conveyance operation in the printing apparatus according to the embodiment of the present invention.
Figure 3:
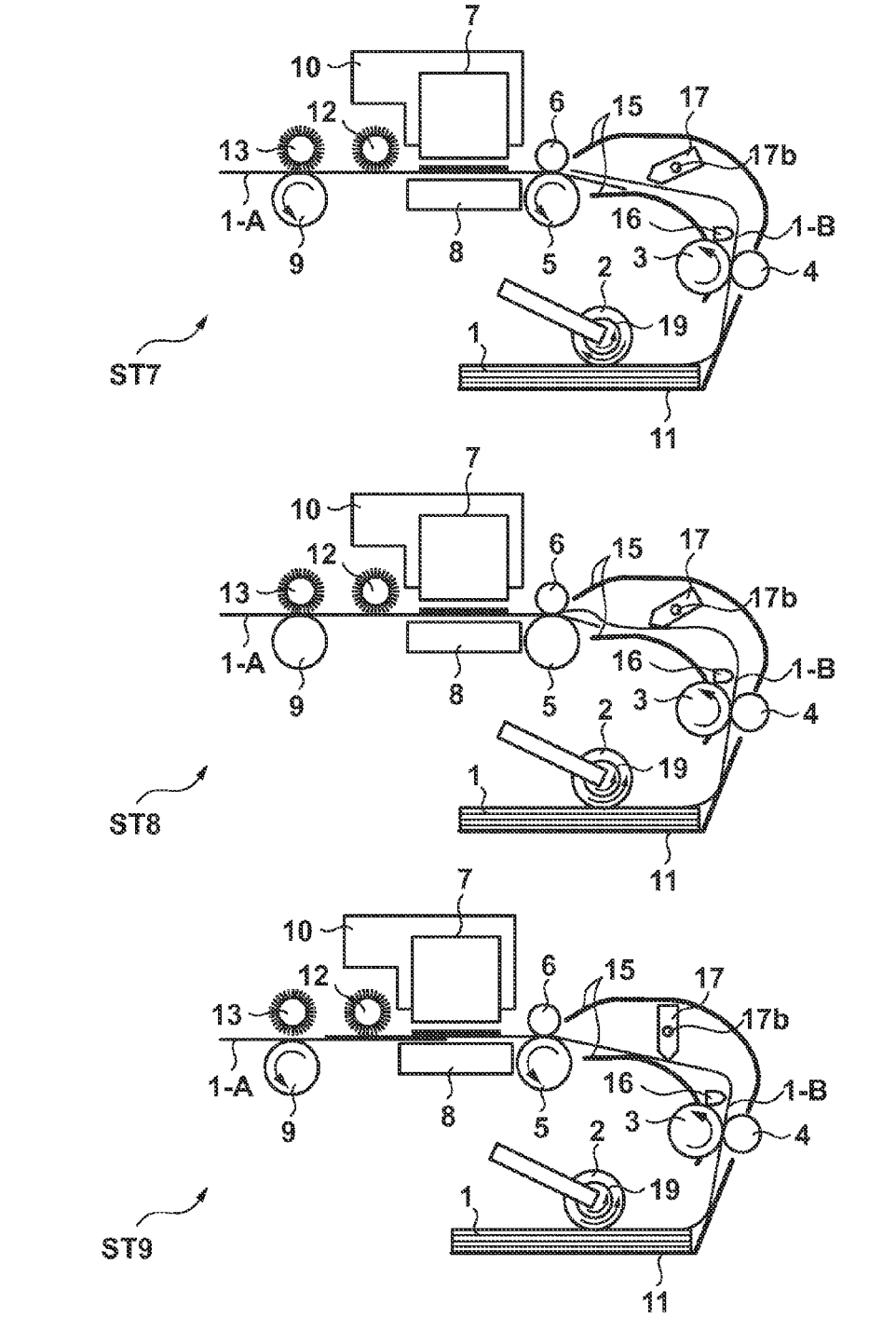
FIG. 3 is a view for explaining the successive overlapped conveyance operation in the printing apparatus according to the embodiment of the present invention.

FIGS. 1 to 3 are sectional views for explaining a successive overlapped conveyance operation in a printing apparatus according to the embodiment of the present invention. The schematic arrangement of the printing apparatus according to the embodiment will first be described with reference to ST1 of FIG. 1.

In ST1 of FIG. 1, reference numeral 1 denotes printing sheets. The plurality of printing sheets 1 are stacked on a feeding tray 11 (a stacking unit). A pickup roller 2 abuts against the top printing sheet 1 stacked on the feeding tray 11 to pick it up. A feeding roller 3 feeds the printing sheet 1 picked up by the pickup roller 2 toward the downstream side of a sheet conveyance direction. A feeding driven roller 4 is biased against the feeding roller 3 to sandwich the printing sheet 1 with the feeding roller 3, thereby feeding the printing sheet 1.

A conveyance roller 5 conveys the printing sheet 1 fed by the feeding roller 3 and feeding driven roller 4 to a position facing a printhead 7. A pinch roller 6 is biased against the conveyance roller 5 to sandwich the printing sheet with the conveyance roller 5, thereby conveying the printing sheet.

The printhead 7 prints the printing sheet 1 conveyed by the conveyance roller 5 and pinch roller 6. In this embodiment, an inkjet printhead which prints the printing sheet 1 by discharging ink from the printhead 7 will be exemplified. A platen 8 supports the reverse surface of the printing sheet 1 at the position facing the printhead 7. A carriage 10 mounts the printhead 7 and moves in a direction intersecting the sheet conveyance direction.

A discharge roller 9 discharges the printing sheet printed by the printhead 7 to the outside of the apparatus. Spurs 12 and 13 rotate while they are in contact with the printing surface of the printing sheet printed by the printhead 7. The spur 13 on the downstream side is biased against the discharge roller 9, and no discharge roller 9 is arranged at a position facing the spur 12 on the upstream side. The spur 12 is used to prevent the floating of the printing sheet 1, and is also referred to as a pressing spur.

A conveyance guide 15 guides the printing sheet 1 between a feeding nip portion formed by the feeding roller 3 and feeding driven roller 4 and a conveyance nip portion formed by the conveyance roller 5 and pinch roller 6. A sheet detection sensor 16 detects the leading edge and trailing edge of the printing sheet 1. The sheet detection sensor 16 is provided downstream of the feeding roller 3 in the sheet conveyance direction. A sheet pressing lever 17 makes the leading edge of the succeeding sheet overlap the trailing edge of the preceding sheet. The sheet pressing lever 17 is biased by a spring around a rotating shaft 17*b* in a counterclockwise direction shown in FIG. 1.

Figure 4A:
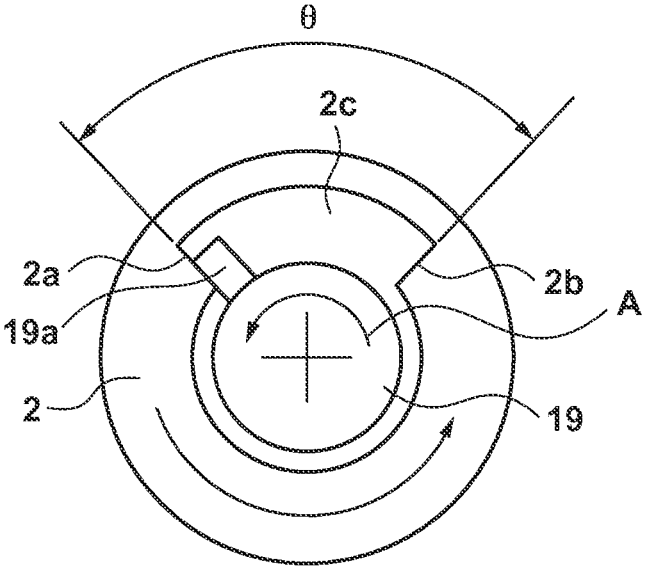
FIGS. 4A and 4B are views for explaining the arrangement of a pickup roller.
Figure 4B:
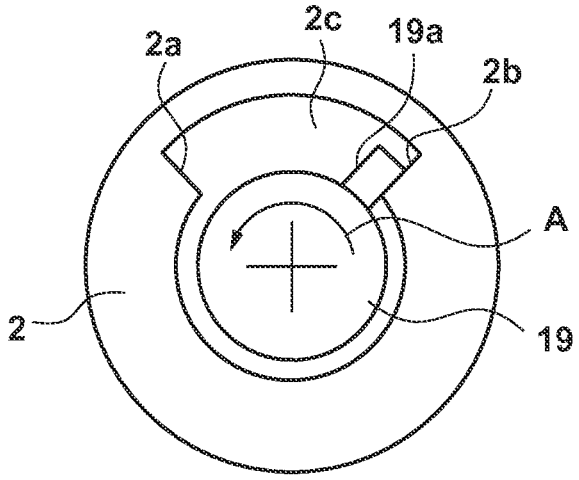

FIGS. 4A and 4B are views for explaining the arrangement of the pickup roller 2. As described above, the pickup roller 2 abuts against the top printing sheet stacked on the feeding tray 11 to pick it up. A driving shaft 19 transmits driving of a feeding motor (to be described later) to the pickup roller 2. When picking up the printing sheet, the driving shaft 19 and the pickup roller 2 rotate in a direction indicated by an arrow A in FIGS. 4A and 4B. A projection 19*a* is formed in the driving shaft 19. A concave portion 2*c* in which the projection 19*a* fits is formed in the pickup roller 2. As shown in FIG. 4A, when the projection 19*a* abuts against a first surface 2*a* of the concave portion 2*c* of the pickup roller 2, driving of the driving shaft 19 is transmitted to the pickup roller 2. In this case, when the driving shaft 19 is driven, the pickup roller 2 is also rotated. On the other hand, as shown in FIG. 4B, when the projection 19*a* abuts against a second surface 2*b* of the concave portion 2*c* of the pickup roller 2, driving of the driving shaft 19 is not transmitted to the pickup roller 2. In this case, even if the driving shaft 19 is driven, the pickup roller 2 is not rotated. Also, when the projection 19*a* is formed between the first surface 2*a* and the second surface 2*b* without abutting against the first surface 2*a* or the second surface 2*b*, even if the driving shaft 19 is driven, the pickup roller 2 is not rotated.

Figure 5:
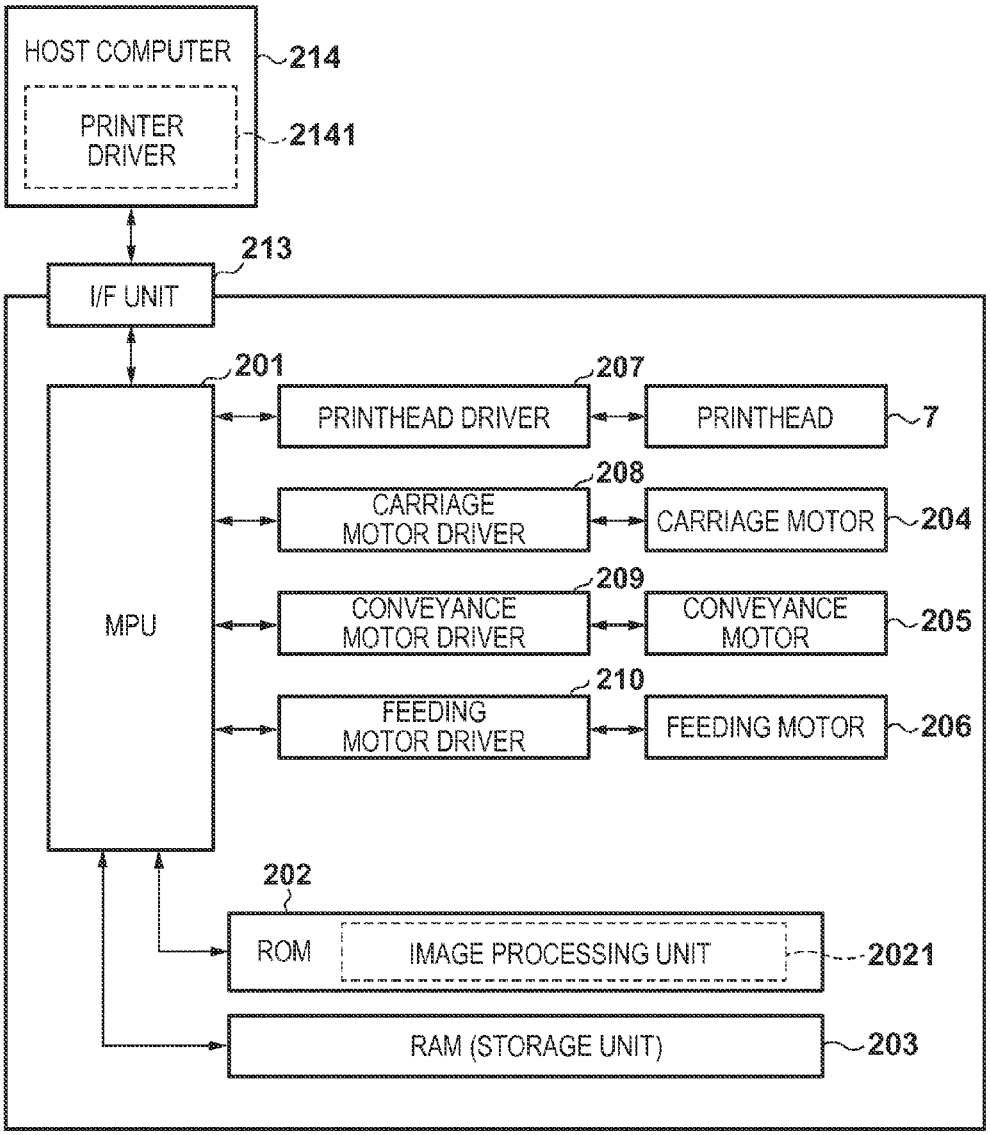
FIG. 5 is a block diagram showing the printing apparatus according to the embodiment.

FIG. 5 is a block diagram showing the printing apparatus according to this embodiment. An MPU 201 controls the operation of each unit, data processing, and the like. As will be described later, the MPU 201 also functions as a conveyance control unit capable of controlling conveyance of the printing sheets so that the trailing edge of a preceding sheet and the leading edge of a succeeding sheet overlap each other. A ROM 202 stores data and programs to be executed by the MPU 201. A RAM 203 temporarily stores processing data to be executed by the MPU 201 and data received from a host computer 214. When continuously printing on the first surfaces of the plurality of printing sheets, the MPU 201 controls to form an overlap state in which the leading edge of the succeeding sheet overlaps the trailing edge of the preceding sheet. Alternatively, when performing double-sided printing on the first and second surfaces of the printing sheet, the MPU 201 does not control to form the overlap state.

A printhead driver 207 controls the printhead 7. A carriage motor driver 208 controls a carriage motor 204 for driving the carriage 10. A conveyance motor 205 drives the conveyance roller 5 and discharge roller 9. A conveyance motor driver 209 controls the conveyance motor 205. A feeding motor 206 drives the pickup roller 2 and feeding roller 3. A feeding motor driver 210 controls the feeding motor 206.

In the host computer 214, a printer driver 2141 is used to communicate with the printing apparatus by collecting printing information such as a printing image and printing image quality when the user instructs the execution of a printing operation. The MPU 201 exchanges the printing image and the like with the host computer 214 via an I/F unit 213.

The successive overlapped conveyance operation will be described in time series with reference to ST1 of FIG. 1 to ST9 of FIG. 3. When the host computer 214 transmits printing data via the I/F unit 213, the printing data is processed by the MPU 201, and then loaded into the RAM 203. The MPU 201 starts a printing operation based on the loaded data.

A description will be provided with reference to ST1 of FIG. 1. The feeding motor driver 210 drives the feeding motor 206 at low speed. This rotates the pickup roller 2 at 7.6 inches/sec. When the pickup roller 2 rotates, the top printing sheet (a preceding sheet 1-A) stacked on the feeding tray 11 is picked up. The preceding sheet 1-A picked up by the pickup roller 2 is conveyed by the feeding roller 3 rotating in the same direction as that of the pickup roller 2. The feeding motor 206 also drives the feeding roller 3. This embodiment will be described by using an arrangement including the pickup roller 2 and the feeding roller 3.

However, an arrangement including only a feeding roller for feeding the printing sheet stacked on the stacking unit may be adopted.

When the sheet detection sensor 16 provided on the downstream side of the feeding roller 3 detects the leading edge of the preceding sheet 1-A, the feeding motor 206 is switched to high-speed driving. That is, the pickup roller 2 and feeding roller 3 rotate at 20 inches/sec.

A description will be provided with reference to ST2 of FIG. 1. When the feeding roller 3 is continuously rotated, the leading edge of the preceding sheet 1-A rotates the sheet pressing lever 17 about the rotating shaft 17*b* in the clockwise direction against the biasing force of the spring. When the feeding roller 3 is further continuously rotated, the leading edge of the preceding sheet 1-A abuts against the conveyance nip portion formed by the conveyance roller 5 and pinch roller 6. At this time, the conveyance roller 5 stops. By rotating the feeding roller 3 by a predetermined amount even after the leading edge of the preceding sheet 1-A abuts against the conveyance nip portion, alignment of the preceding sheet 1-A is performed to correct the skew while the leading edge of the preceding sheet 1-A abuts against the conveyance nip portion. The skew correction operation will also be referred to as a registration adjustment operation.

A description will be provided with reference to ST3 of FIG. 1. Upon end of the skew correction operation of the preceding sheet 1-A, the conveyance motor 205 is driven to start rotation of the conveyance roller 5. The conveyance roller 5 conveys the sheet at 15 inches/sec. After the preceding sheet 1-A is aligned with the position facing the printhead 7, a printing operation is performed by discharging ink from the printhead 7 based on the printing data. Note that the alignment operation is performed by making the leading edge of the printing sheet abut against the conveyance nip portion to temporarily position the printing sheet at the position of the conveyance roller 5, and controlling the rotation amount of the conveyance roller 5 with reference to the position of the conveyance roller 5.

The printing apparatus of this embodiment is a serial type printing apparatus in which the carriage 10 mounts the printhead 7. The printing operation of the printing sheet is performed by repeating a conveyance operation of intermittently conveying the printing sheet by a predetermined amount using the conveyance roller 5 and an image forming operation of discharging ink from the printhead 7 while moving the carriage 10 incorporating the printhead 7 when the conveyance roller 5 stops.

When alignment of the preceding sheet 1-A is performed, the feeding motor 206 is switched to low-speed driving. That is, the pickup roller 2 and feeding roller 3 rotate at 7.6 inches/sec. While the conveyance roller 5 intermittently conveys the printing sheet by the predetermined amount, the feeding motor 206 also intermittently drives the feeding roller 3. That is, while the conveyance roller 5 rotates, the feeding roller 3 also rotates. While the conveyance roller 5 stops, the feeding roller 3 also stops. The rotation speed of the feeding roller 3 is lower than that of the conveyance roller 5. Consequently, the sheet is stretched between the conveyance roller 5 and the feeding roller 3. The feeding roller 3 is rotated together with the printing sheet conveyed by the conveyance roller 5.

Since the feeding motor 206 is intermittently driven, the driving shaft 19 is also driven. As described above, the rotation speed of the pickup roller 2 is lower than that of the conveyance roller 5. Consequently, the pickup roller 2 is rotated together with the printing sheet conveyed by the conveyance roller 5. That is, the pickup roller 2 rotates ahead of the driving shaft 19. More specifically, the projection 19*a* of the driving shaft 19 is spaced apart from the first surface 2*a* and abuts against the second surface 2*b*. Therefore, the second printing sheet (a succeeding sheet 1-B) is not picked up soon after the trailing edge of the preceding sheet 1-A passes through the pickup roller 2. After the driving shaft 19 is driven for a predetermined time, the projection 19*a* abuts against the first surface 2*a* and the pickup roller 2 starts to rotate.

A description will be provided with reference to ST4 of FIG. 2. In ST4, a state in which the pickup roller 2 starts to rotate, and picks up the succeeding sheet 1-B is shown. Due to a factor such as the responsiveness of the sensor, the sheet detection sensor 16 requires a predetermined interval or more between the printing sheets to detect the edges of the printing sheets. That is, it is necessary to separate the leading edge of the succeeding sheet 1-B from the trailing edge of the preceding sheet 1-A by a predetermined distance to provide a predetermined time interval from when the sheet detection sensor 16 detects the trailing edge of the preceding sheet 1-A until it detects the leading edge of the succeeding sheet 1-B. To achieve this, the angle of the concave portion 2*c* of the pickup roller 2 is set to about 70°.

A description will be provided with reference to ST5 of FIG. 2. The succeeding sheet 1-B picked up by the pickup roller 2 is conveyed by the feeding roller 3. At this time, the preceding sheet 1-A undergoes an image forming operation by the printhead 7 based on the printing data. When the sheet detection sensor 16 detects the leading edge of the succeeding sheet 1-B, the feeding motor 206 is switched to high-speed driving. That is, the pickup roller 2 and feeding roller 3 rotate at 20 inches/sec.

A description will be provided with reference to ST6 of FIG. 2. The sheet pressing lever 17 presses the trailing edge of the preceding sheet 1-A downward, as shown in ST5 of FIG. 2. It is possible to form a state in which the leading edge of the succeeding sheet 1-B overlaps the trailing edge of the preceding sheet 1-A by moving the succeeding sheet 1-B at a speed higher than that at which the preceding sheet 1-A moves downstream by the printing operation of the printhead 7 (ST6 of FIG. 2). Since the preceding sheet 1-A undergoes the printing operation based on the printing data, it is intermittently conveyed by the conveyance roller 5. On the other hand, after the sheet detection sensor 16 detects the leading edge of the succeeding sheet 1-B, the succeeding sheet 1-B can catch up with the preceding sheet 1-A by continuously rotating the feeding roller 3 at 20 inches/sec.

A description will be provided with reference to ST7 of FIG. 3. After forming an overlap state in which the leading edge of the succeeding sheet 1-B overlaps the trailing edge of the preceding sheet 1-A, the succeeding sheet 1-B is conveyed by the feeding roller 3 until the leading edge of the succeeding sheet 1-B stops at a predetermined position upstream of the conveyance nip portion. The position of the leading edge of the succeeding sheet 1-B is calculated from the rotation amount of the feeding roller 3 after the sheet detection sensor 16 detects the leading edge of the succeeding sheet 1-B, and controlled based on the calculation result. At this time, the preceding sheet 1-A undergoes an image forming operation by the printhead 7 based on the printing data.

A description will be provided with reference to ST8 of FIG. 3. When the conveyance roller 5 stops to perform the image forming operation (ink discharge operation) of the last row of the preceding sheet 1-A, the feeding roller 3 is driven to make the leading edge of the succeeding sheet 1-B abut against the conveyance nip portion, thereby performing the skew correction operation of the succeeding sheet 1-B.

A description will be provided with reference to ST9 of FIG. 3. When the image forming operation of the last row of the preceding sheet 1-A ends, it is possible to perform alignment of the succeeding sheet 1-B while keeping the state in which the succeeding sheet 1-B overlaps the preceding sheet 1-A by rotating the conveyance roller 5 by a predetermined amount. The succeeding sheet 1-B undergoes a printing operation by the printhead 7 based on the printing data. When the succeeding sheet 1-B is intermittently conveyed for the printing operation, the preceding sheet 1-A is also intermittently conveyed, and is finally discharged outside the printing apparatus by the discharge roller 9.

When alignment of the succeeding sheet 1-B is performed, the feeding motor 206 is switched to low-speed driving. That is, the pickup roller 2 and feeding roller 3 rotate at 7.6 inches/sec. If there is printing data even after the succeeding sheet 1-B, the process returns to ST4 of FIG. 2 to pick up the third printing sheet.

Figure 6A:
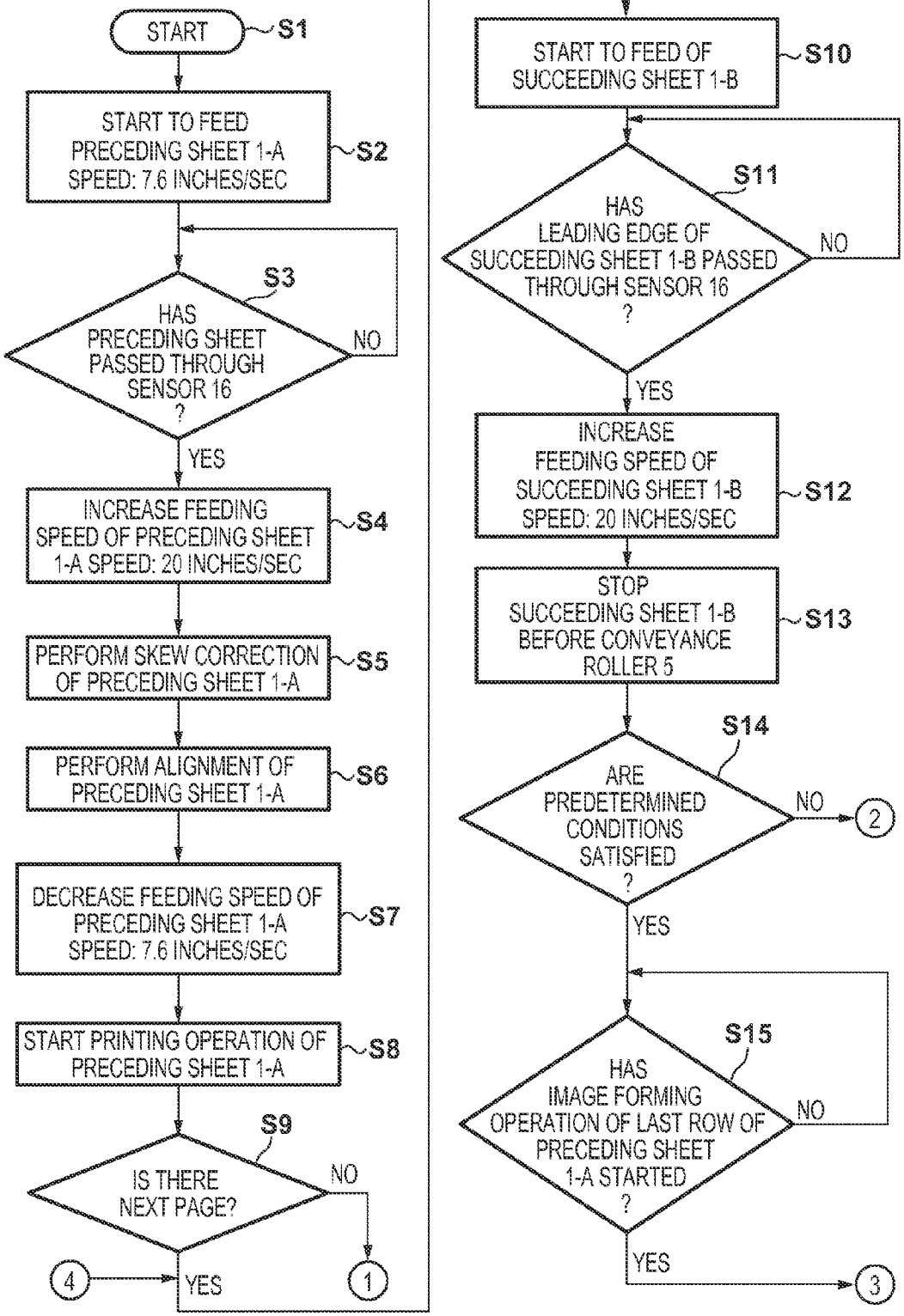
FIGS. 6A and 6B are flowcharts illustrating a successive overlapped conveyance sequence according to the embodiment.
Figure 6B:
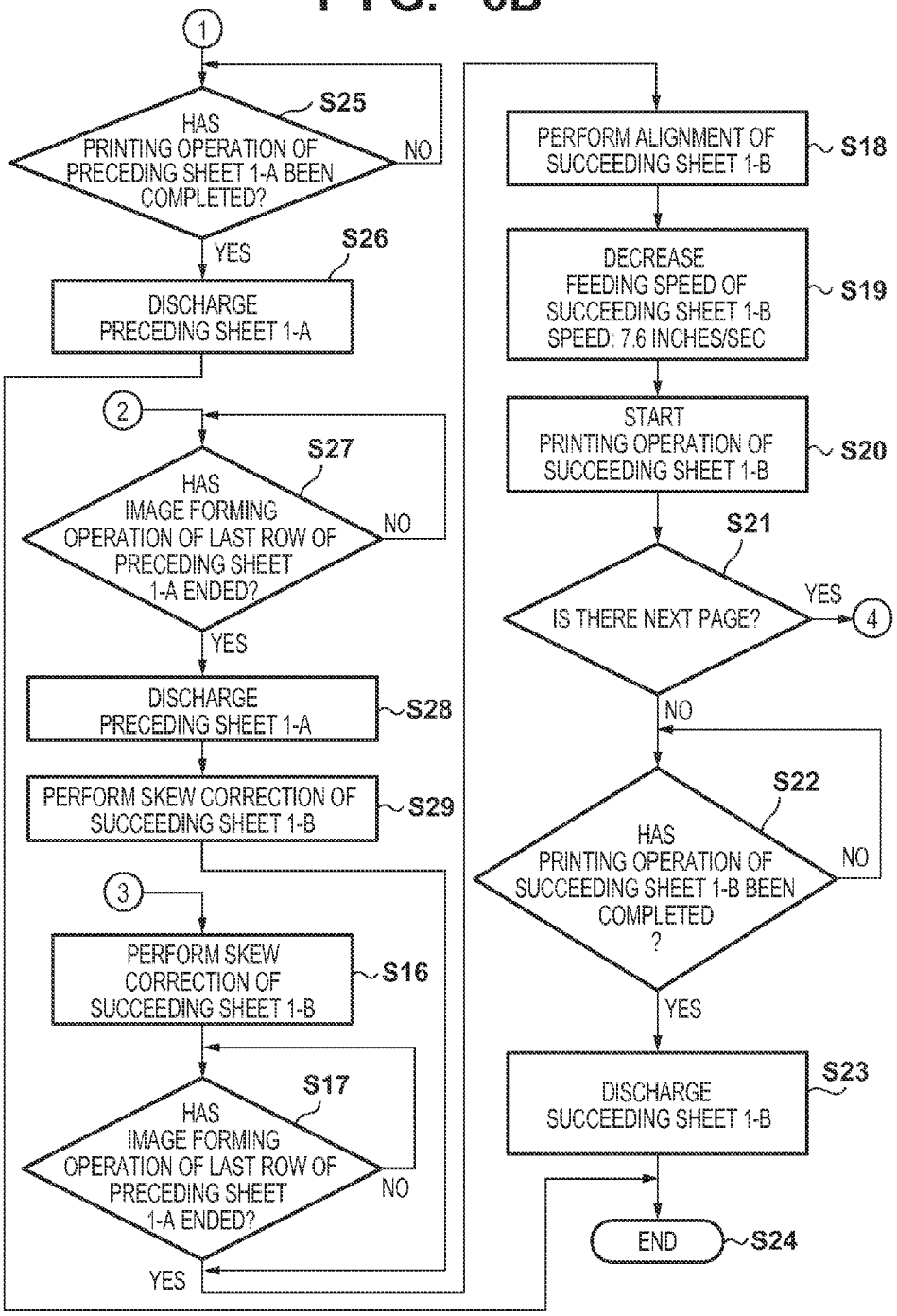

FIGS. 6A and 6B are flowcharts illustrating the successive overlapped conveyance operation according to this embodiment. In step S1, when the host computer 214 transmits printing data via the I/F unit 213, a printing operation starts. In step S2, the feeding operation of the preceding sheet 1-A starts. More specifically, the feeding motor 206 is driven at low speed. The pickup roller 2 rotates at 7.6 inches/sec. The pickup roller 2 picks up the preceding sheet 1-A, and the feeding roller 3 feeds the preceding sheet 1-A toward the printhead 7.

In step S3, the sheet detection sensor 16 detects the leading edge of the preceding sheet 1-A. When the sheet detection sensor 16 detects the leading edge of the preceding sheet 1-A (YES in step S3), the feeding motor 206 is switched to high-speed driving in step S4. That is, the pickup roller 2 and feeding roller 3 rotate at 20 inches/sec. In step S5, by controlling the rotation amount of the feeding roller 3 after the sheet detection sensor 16 detects the leading edge of the preceding sheet 1-A, the leading edge of the preceding sheet 1-A is made to abut against the conveyance nip portion to perform the skew correction operation of the preceding sheet 1-A.

In step S6, alignment of the preceding sheet 1-A is performed based on the printing data. That is, the preceding sheet 1-A is conveyed to a printing start position with reference to the position of the conveyance roller 5 based on the printing data by controlling the rotation amount of the conveyance roller 5. In step S7, the feeding motor 206 is switched to low-speed driving. In step S8, a printing operation starts when the printhead 7 discharges ink to the preceding sheet 1-A. More specifically, the printing operation of the preceding sheet 1-A is performed by repeating a conveyance operation of intermittently conveying the preceding sheet 1-A by the conveyance roller 5 and an image forming operation (ink discharge operation) of discharging ink from the printhead 7 by moving the carriage 10. The feeding motor 206 is intermittently driven at low speed in synchronization with the operation of intermittently conveying the preceding sheet 1-A by the conveyance roller 5. That is, the pickup roller 2 and feeding roller 3 intermittently rotate at 7.6 inches/sec.

In step S9, it is determined whether there is printing data of the next page. If there is no printing data of the next page, the process advances to step S25. Upon completion of the printing operation of the preceding sheet 1-A in step S25, the preceding sheet 1-A is discharged in step S26, thereby terminating the printing operation.

If there is printing data of the next page, the feeding operation of the succeeding sheet 1-B starts in step S10. More specifically, the pickup roller 2 picks up the succeeding sheet 1-B, and the feeding roller 3 feeds the succeeding sheet 1-B toward the printhead 7. The pickup roller 2 rotates at 7.6 inches/sec. As described above, since the large concave portion 2*c* of the pickup roller 2 is provided with respect to the projection 19*a* of the driving shaft 19, the succeeding sheet 1-B is fed while having a predetermined interval with respect to the trailing edge of the preceding sheet 1-A.

In step S11, the sheet detection sensor 16 detects the leading edge of the succeeding sheet 1-B. When the sheet detection sensor 16 detects the leading edge of the succeeding sheet 1-B, the feeding motor 206 is switched to high-speed driving in step S12. That is, the pickup roller 2 and feeding roller 3 rotate at 20 inches/sec. In step S13, by controlling the rotation amount of the feeding roller 3 after the sheet detection sensor 16 detects the leading edge of the succeeding sheet 1-B, the succeeding sheet 1-B is conveyed so that its leading edge is at a position a predetermined amount before the conveyance nip portion. The preceding sheet 1-A is intermittently conveyed based on the printing data. Continuously driving the feeding motor 206 at high speed forms the overlap state in which the leading edge of the succeeding sheet 1-B overlaps the trailing edge of the preceding sheet 1-A.

In step S14, it is determined whether predetermined conditions (to be described later) are satisfied. If the predetermined conditions are satisfied, it is determined in step S15 whether the image forming operation of the preceding sheet 1-A has started. If it is determined that the image forming operation has started, the process advances to step S16; otherwise, the process stands by until the image forming operation starts. In step S16, the leading edge of the succeeding sheet 1-B is made to abut against the conveyance nip portion while keeping the overlap state, thereby performing the skew correction operation of the succeeding sheet 1-B. If it is determined in step S17 that the image forming operation of the last row of the preceding sheet 1-A has ended, in step S18 alignment of the succeeding sheet 1-B is performed while keeping the overlap state.

If it is determined in step S14 that the predetermined conditions are not satisfied, the overlap state is canceled to perform alignment of the succeeding sheet 1-B. More specifically, if it is determined in step S27 that the image forming operation of the last row of the preceding sheet 1-A has ended, the discharge operation of the preceding sheet 1-A is performed in step S28. During this operation, the feeding motor 206 is not driven, and thus the succeeding sheet 1-B stops while its leading edge is at the position the predetermined amount before the conveyance nip portion. Since the preceding sheet 1-A is discharged, the overlap state is canceled. In step S29, the leading edge of the succeeding sheet 1-B is made to abut against the conveyance nip portion to perform the skew correction operation of the succeeding sheet 1-B. In step S18, alignment of the succeeding sheet 1-B is performed.

In step S19, the feeding motor 206 is switched to low-speed driving. In step S20, a printing operation starts by discharging ink from the printhead 7 to the succeeding sheet 1-B. More specifically, the printing operation of the succeeding sheet 1-B is performed by repeating a conveyance operation of intermittently conveying the succeeding sheet 1-B by the conveyance roller 5 and an image forming operation (ink discharge operation) of discharging ink from the printhead 7 by moving the carriage 10. The feeding motor 206 is intermittently driven at low speed in synchronization with the operation of intermittently conveying the succeeding sheet 1-B by the conveyance roller 5. That is, the pickup roller 2 and feeding roller 3 intermittently rotate at 7.6 inches/sec.

In step S21, it is determined whether there is printing data of the next page. If there is printing data of the next page, the process returns to step S10. If there is no printing data of the next page, when the image forming operation of the succeeding sheet 1-B is complete in step S22, the discharge operation of the succeeding sheet 1-B is performed in step S23 and the printing operation ends in step S24.

Figure 7:
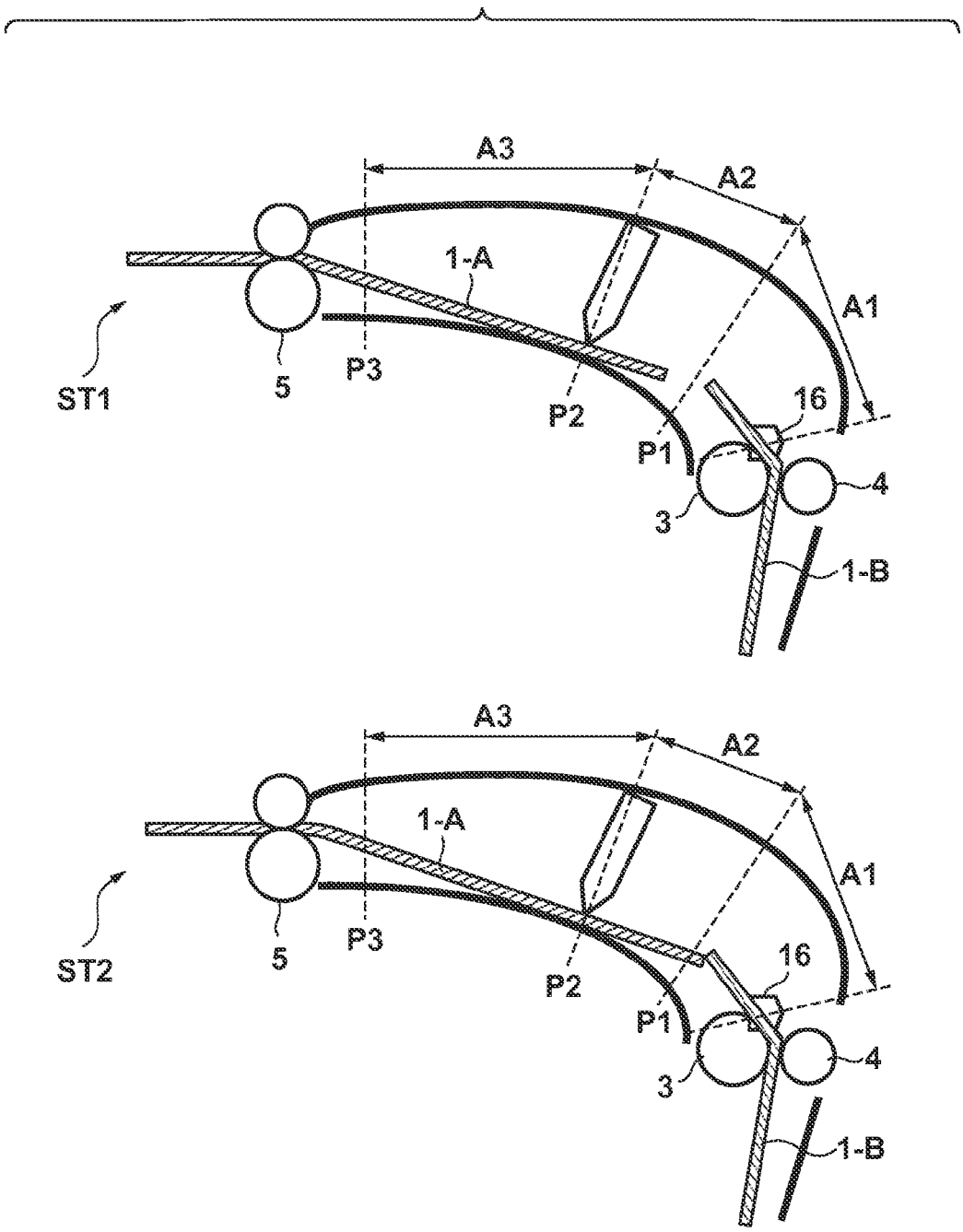
FIG. 7 is a view for explaining an operation of making a succeeding sheet overlap a preceding sheet.
Figure 8:
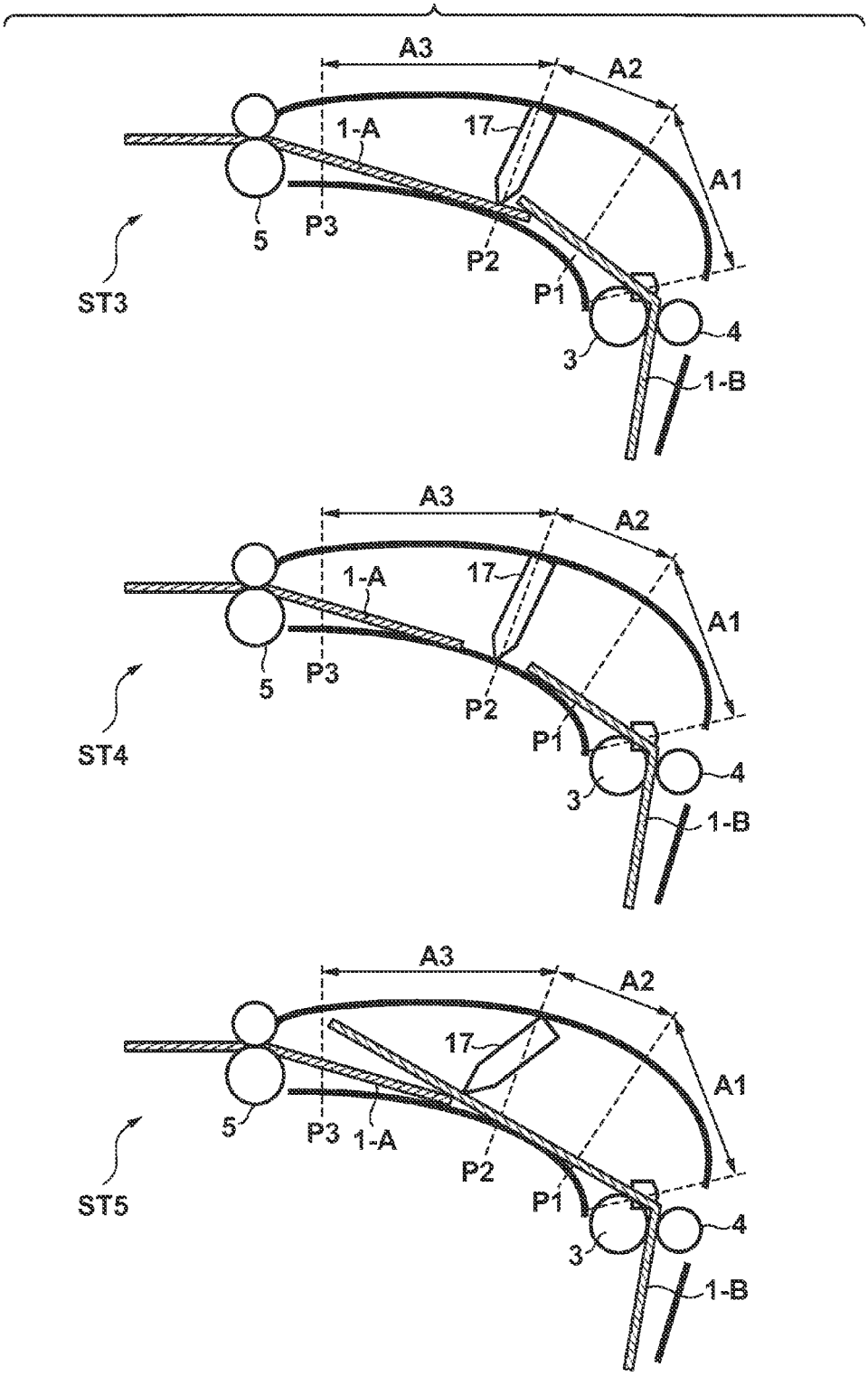
FIG. 8 is a view for explaining the operation of making the succeeding sheet overlap the preceding sheet.

FIGS. 7 and 8 are views for explaining an operation of making the succeeding sheet overlap the preceding sheet according to this embodiment. The operation of forming the overlap state in which the leading edge of the succeeding sheet overlaps the trailing edge of the preceding sheet, which has been explained in steps S12 and S13 of FIG. 6A, will be described.

FIGS. 7 and 8 are enlarged views each showing a portion between the feeding nip portion formed by the feeding roller 3 and feeding driven roller 4 and the conveyance nip portion formed by the conveyance roller 5 and pinch roller 6.

Three states in a process of conveying the printing sheets by the conveyance roller 5 and feeding roller 3 will be sequentially described. The first state in which an operation of making the succeeding sheet chase the preceding sheet is performed will be described with reference to ST1 and ST2 of FIG. 7. The second state in which an operation of making the succeeding sheet overlap the preceding sheet is performed will be described with reference to ST3 and ST4 of FIG. 8. The third state in which it is determined whether to perform the skew correction operation of the succeeding sheet while keeping the overlap state will be described with reference to ST5 of FIG. 8.

In ST1 of FIG. 7, the feeding roller 3 is controlled to convey the succeeding sheet 1-B, and the sheet detection sensor 16 detects the leading edge of the succeeding sheet 1-B. A section from the sheet detection sensor 16 to a position P1 at which the succeeding sheet 1-B can be made to overlap the preceding sheet 1-A is defined as a first section A1. In the first section A1, an operation of making the leading edge of the succeeding sheet 1-B chase the trailing edge of the preceding sheet 1-A is performed. The position P1 is decided based on the arrangement of the mechanism.

In the first state, the chasing operation may stop in the first section A1. If, as shown in ST2 of FIG. 7, the leading edge of the succeeding sheet 1-B passes the trailing edge of the preceding sheet 1-A before the position P1, the operation of making the succeeding sheet overlap the preceding sheet is not performed.

In ST3 of FIG. 8, a section from the above-described position P1 to a position P2 at which the sheet pressing lever 17 is provided is defined as a second section A2. In the second section A2, the operation of making the succeeding sheet 1-B overlap the preceding sheet 1-A is performed.

In the second state, the operation of making the succeeding sheet overlap the preceding sheet may stop in the second section A2. If, as shown in ST4 of FIG. 8, the leading edge of the succeeding sheet 1-B cannot catch up with the trailing edge of the preceding sheet 1-A within the second section A2, it is impossible to perform the operation of making the succeeding sheet overlap the preceding sheet.

In ST5 of FIG. 8, a section from the above-described position P2 to a position P3 is defined as a third section A3. The position P3 is the position of the leading edge of the succeeding sheet when the succeeding sheet stops in step S13 of FIG. 6A. While the succeeding sheet 1-B overlaps the preceding sheet 1-A, the succeeding sheet 1-B is conveyed so that its leading edge reaches the position P3. In the third section A3, it is determined whether to perform alignment of the succeeding sheet 1-B by making it abut against the conveyance nip portion while keeping the overlap state. That is, it is determined whether to perform alignment of the succeeding sheet by executing a skew correction operation while keeping the overlap state or to perform alignment of the succeeding sheet by canceling the overlap state and performing a skew correction operation.

Figure 9:
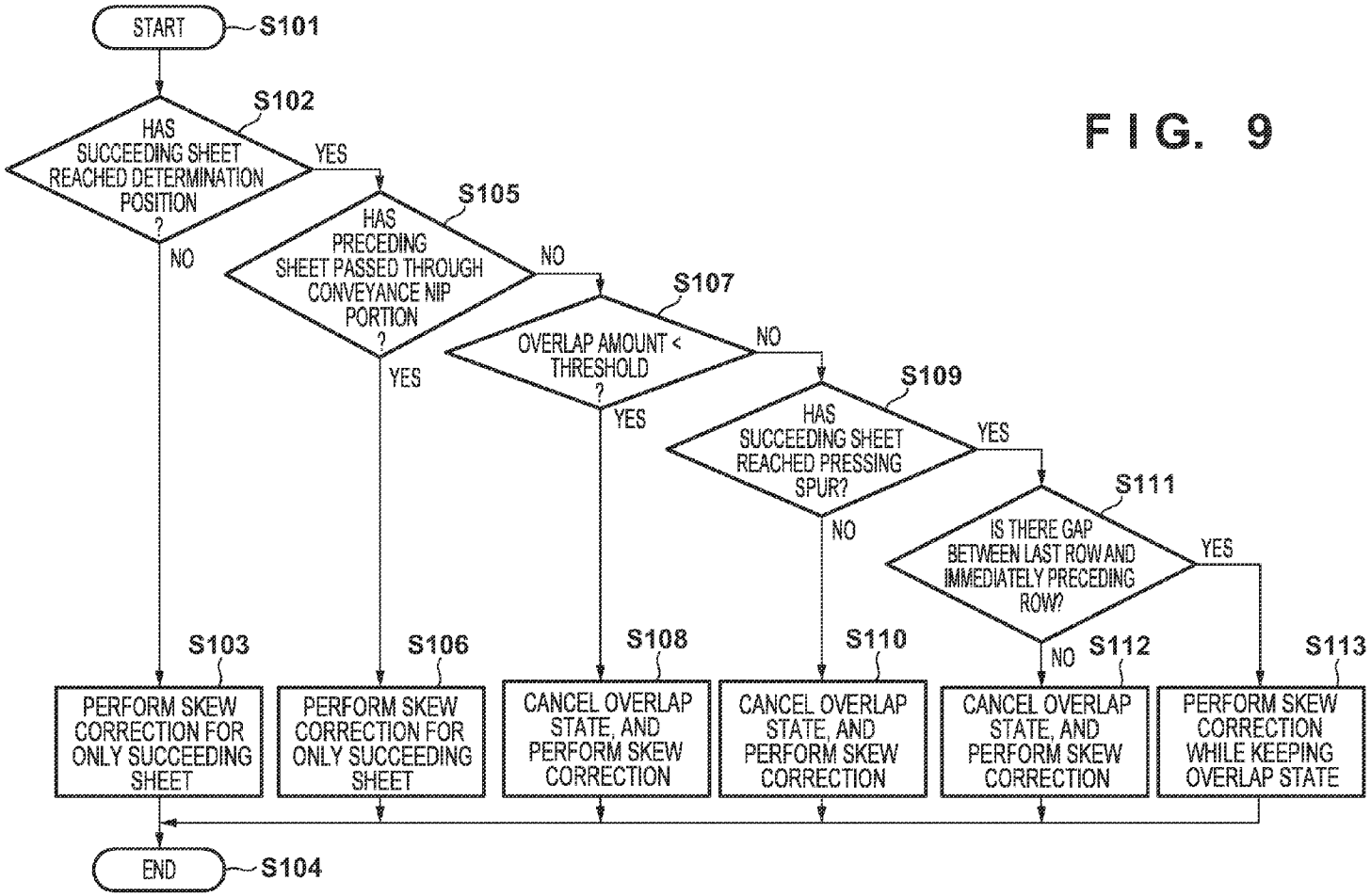
FIG. 9 is a flowchart for explaining the skew correction operation of the succeeding sheet according to the embodiment.

FIG. 9 is a flowchart for explaining the skew correction operation of the succeeding sheet according to this embodiment. The processing of determining whether the predetermined conditions are satisfied, which has been explained in step S14 of FIG. 6A, will be described in detail.

The operation of determining whether to perform a skew correction operation by making the leading edge of the succeeding sheet 1-B abut against the conveyance nip portion while keeping the overlap state between the preceding sheet 1-A and the succeeding sheet 1-B or to perform a skew correction operation by canceling the overlap state between the preceding sheet 1-A and the succeeding sheet 1-B and then making the leading edge of the succeeding sheet 1-B abut against the conveyance nip portion will be described.

In step S101, the operation starts. In step S102, it is determined whether the leading edge of the succeeding sheet 1-B has reached the determination position (the position P3 in ST5 of FIG. 8). If the leading edge of the succeeding sheet 1-B has not reached the determination position (NO in step S102), it is uncertain whether the leading edge of the succeeding sheet 1-B abuts against the conveyance nip portion by conveying the succeeding sheet 1-B by a predetermined amount, and thus a skew correction operation for only the succeeding sheet is decided (step S103), thereby terminating the determination operation (step S104). That is, after the trailing edge of the preceding sheet 1-A passes through the conveyance nip portion, only the succeeding sheet 1-B is made to abut against the conveyance nip portion to perform a skew correction operation, and then alignment of only the succeeding sheet 1-B is performed.

On the other hand, if it is determined that the leading edge of the succeeding sheet 1-B has reached the determination position P3 (YES in step S102), it is determined whether the trailing edge of the preceding sheet 1-A has passed through the conveyance nip portion (step S105). If it is determined that the trailing edge of the preceding sheet 1-A has passed through the conveyance nip portion (YES in step pS105), the succeeding sheet does not overlap the preceding sheet, and thus a skew correction operation for only the succeeding sheet is decided (step S106). That is, only the succeeding sheet 1-B is made to abut against the conveyance nip portion to perform a skew correction operation, and then alignment of only the succeeding sheet 1-B is performed.

On the other hand, if it is determined that the trailing edge of the preceding sheet 1-A has not passed through the conveyance nip portion (NO in step S105), it is determined whether the overlap amount of the trailing edge of the preceding sheet 1-A and the leading edge of the succeeding sheet 1-B is smaller than a threshold (step S107). The position of the trailing edge of the preceding sheet 1-A is updated along with the printing operation of the preceding sheet 1-A. The position of the leading edge of the succeeding sheet 1-B is at the above-described determination position. That is, the overlap amount decreases along with the printing operation of the preceding sheet 1-A. If it is determined that the overlap amount is smaller than the threshold (YES in step S107), the overlap state is canceled, and a skew correction operation for only the succeeding sheet is decided (step S108). That is, after the image forming operation of the preceding sheet 1-A ends, the succeeding sheet 1-B is not conveyed together with the preceding sheet 1-A. More specifically, the conveyance motor 205 drives the conveyance roller 5 to convey the preceding sheet 1-A. However, the feeding roller 3 is not driven. Therefore, the overlap state is canceled. Furthermore, only the succeeding sheet 1-B is made to abut against the conveyance nip portion to perform a skew correction operation, and then alignment of only the succeeding sheet 1-B is performed.

If it is determined that the overlap amount is equal to or larger than the threshold (NO in step S107), it is determined whether the succeeding sheet 1-B reaches the pressing spur 12 when alignment of the succeeding sheet 1-B is performed (step S109). If it is determined that the succeeding sheet 1-B does not reach the pressing spur 12 (NO in step S109), the overlap state is canceled and a skew correction operation for only the succeeding sheet is decided (step S110). That is, after the image forming operation of the preceding sheet 1-A ends, the succeeding sheet 1-B is not conveyed together with the preceding sheet 1-A. More specifically, the conveyance motor 205 drives the conveyance roller 5 to convey the preceding sheet 1-A. However, the feeding roller 3 is not driven. Consequently, the overlap state is canceled. Furthermore, only the succeeding sheet 1-B is made to abut against the conveyance nip portion to perform a skew correction operation, and then alignment of only the succeeding sheet 1-B is performed.

If it is determined that the succeeding sheet 1-B reaches the pressing spur 12 (YES in step S109), it is determined whether there is a gap between the last row of the preceding sheet and the row immediately preceding the last row (step S111). If it is determined that there is no gap (NO in step S111), the overlap state is canceled and a skew correction operation for only the succeeding sheet is decided (step S112). If it is determined that there is a gap (YES in step S111), the skew correction operation of the succeeding sheet 1-B is performed while keeping the overlap state, and alignment of the succeeding sheet 1-B is performed (Step S113). That is, during a period from when the image forming operation of the preceding sheet 1-A starts until the image forming operation ends, the succeeding sheet 1-B is made to abut against the conveyance nip portion while overlapping the preceding sheet 1-A. More specifically, the conveyance roller 5 and the feeding roller 3 are rotated by driving the feeding motor 206 together with the conveyance motor 205. After the skew correction operation, alignment of the succeeding sheet 1-B is performed while the succeeding sheet 1-B overlaps the preceding sheet 1-A.

As described above, the operation of determining whether to keep or cancel the overlap state between the preceding sheet 1-A and the succeeding sheet 1-B is performed. The MPU 201 also functions as a printing control unit for controlling, based on the determination result of the determination unit, the printing elements of the printing unit to be used, as will be described later.

Figure 10:
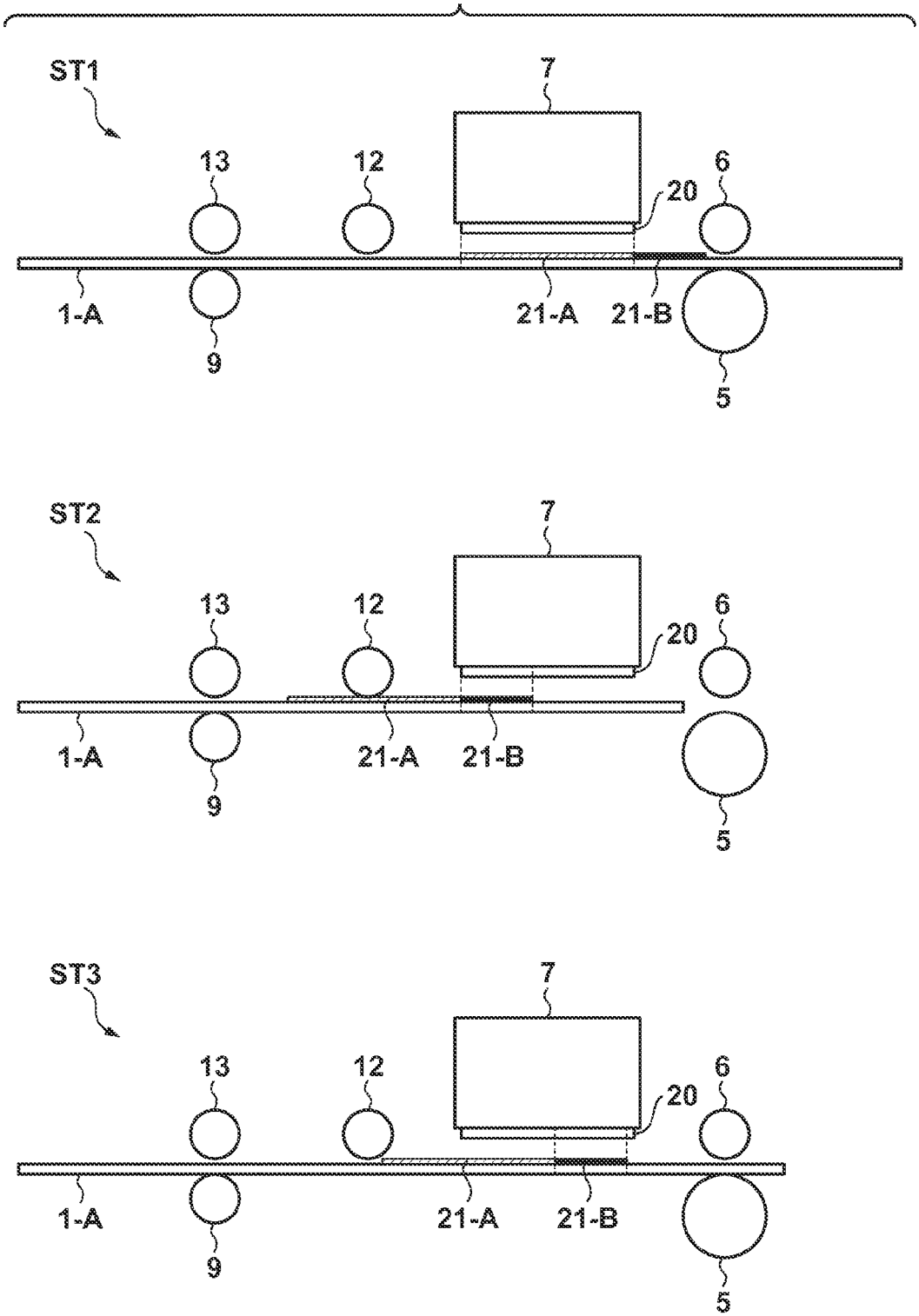
FIG. 10 is a view for explaining a printing operation and the state of the printing apparatus when printing elements to be used are changed according to the embodiment.

FIG. 10 is a view showing a change in state of the printing apparatus at the time of the image forming operation of the last row of the preceding sheet 1-A when the printing elements to be used are changed so as to change the determination result of the determination processing in step S105 of FIG. 9.

A plurality of printing elements 20 are juxtaposed in the printhead 7 in the conveyance direction of the sheet. The printhead 7 discharges ink from some of the printing elements 20 while moving, by the carriage 10, in a direction perpendicular to the sheet conveyance direction once or more, thereby forming an image on the sheet.

Referring to FIG. 10, each of ST1 and ST2 shows the state of the printing apparatus when the printing elements to be used remain unchanged, and ST 3 shows the state of the printing apparatus when the printing elements to be used are changed. In FIG. 10, ST1 is a view showing the state of the printing apparatus at the time of the image forming operation of a row immediately preceding the last row of the preceding sheet 1-A. Ink is discharged from all the printing elements 20 to form an image 21-A on the sheet 1-A. An image 21-B is to be formed on the next row (last row), and is not printed yet upon completion of the printing operation in ST1.

In FIG. 10, ST2 shows the state of the printing apparatus at the time of the image forming operation of the last row of the preceding sheet 1-A when the printing elements 20 to be used remain unchanged. In ST2, the image 21-A has already been formed on the sheet 1-A. In the example shown in ST2, conveyance of the sheets is controlled to form more images by one printing operation. Therefore, among the printing elements 20, printing elements on the more downstream side of the sheet conveyance direction are used to form the image 21-B. In the state shown in ST2, it is determined that the trailing edge of the preceding sheet 1-A has passed through the conveyance nip portion (YES in step S105 of FIG. 9). In the sheet conveyance state shown in ST2, the leading edge of the succeeding sheet 1-B does not overlap the trailing edge of the preceding sheet 1-A, and thus a skew correction operation for only the succeeding sheet is decided (step S106 of FIG. 9).

In FIG. 10, ST3 shows the state of the printing apparatus at the time of the image forming operation of the last row when the printing elements to be used are changed. In this example, a printing operation is performed by a smaller conveyance amount to the extent that it is possible to form the image 21-B. In ST3, the printing elements of the printing unit are controlled to change the use of the printing elements arranged at positions (downstream of the sheet conveyance direction) close to the leading edge of the preceding sheet to the use of the printing elements arranged at positions (upstream of the sheet conveyance direction) close to the trailing edge of the preceding sheet. The conveyance amount is also controlled according to the change of the printing elements to be used. Therefore, among the printing elements 20, the printing elements on the more upstream side of the sheet conveyance direction are used to form the image 21-B.

In the state shown in ST3, a printing operation is performed by a conveyance amount smaller than that in ST2, and thus it is not determined that the trailing edge of the preceding sheet 1-A has passed through the conveyance nip portion (NO in step S105 of FIG. 9). In ST2, the result of the determination processing in step S105 is YES, and the process advance to step S106. On the other hand, if the printing elements to be used are changed as shown in ST3, the result of the determination processing in step S105 is NO, and the process advances to step S107. That is, it is possible to change the result of the determination processing in step S105 of FIG. 9 toward processing (step S113) of performing skew correction while keeping the overlap state by changing the printing elements to be used, as shown in ST3, and controlling the conveyance amount in accordance with the changed printing elements.

Figure 11:
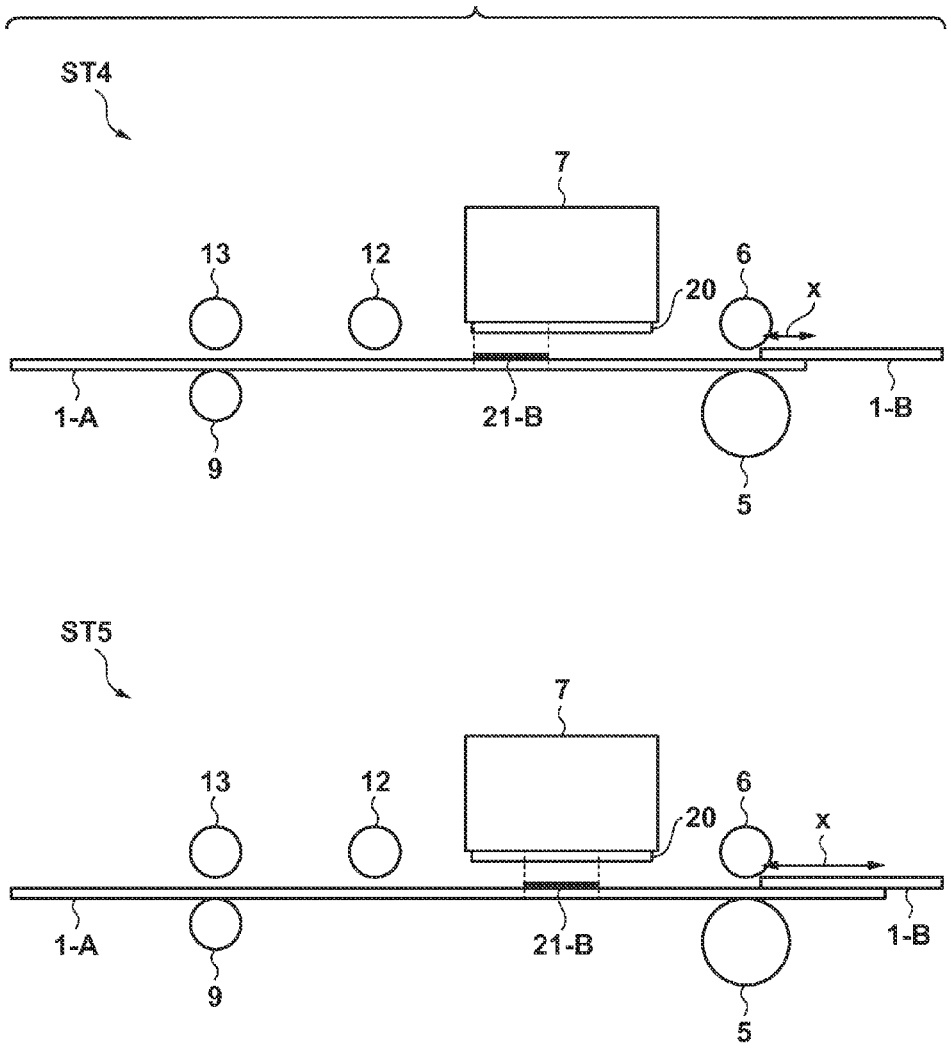
FIG. 11 is a view for explaining the printing operation and the state of the printing apparatus when the printing elements to be used are changed according to the embodiment.

FIG. 11 is a view showing a change in state of the printing apparatus at the time of the image forming operation of the last row of the preceding sheet 1-A when the printing elements to be used are changed so as to change the determination result of the determination processing in step S107 of FIG. 9.

Referring to FIG. 11, ST4 shows the state of the printing apparatus when the printing elements to be used remain unchanged, and ST5 shows the state of the printing apparatus when the printing elements to be used are changed.

In ST4, conveyance is controlled to form the image 21-B using printing elements on the more downstream side of the sheet conveyance direction among the printing elements 20. In the example shown in ST4, it is determined that an overlap amount X of the preceding sheet 1-A and the succeeding sheet 1-B is smaller than a threshold (YES in step S107 of FIG. 9). Therefore, the overlap state of the sheets is canceled, and a skew correction operation for only the succeeding sheet is performed (step S108 of FIG. 9).

In ST5, the state of the printing apparatus at the time of the image forming operation of the last row when the printing elements to be used are changed with respect to ST4 is shown. In this example, the printing elements to be used are changed so that the overlap amount X of the preceding sheet 1-A and succeeding sheet 1-B is equal to or larger than the threshold.

In ST4 of FIG. 11 described above, among the printing elements 20, the printing elements on the more downstream side of the sheet conveyance direction are used to form the image 21-B. In ST5, the difference from ST4 is that the image 21-B is formed by changing the printing elements to be used so that the overlap amount X is equal to or larger than the threshold. In ST5, the printing elements of the printing unit are controlled to change the use of the printing elements arranged at positions close to the leading edge of the preceding sheet to the use of the printing elements arranged at positions close to the trailing edge of the preceding sheet so that the overlap amount is equal to or larger than the threshold. The conveyance amount is also controlled according to the change of the printing elements to be used.

In ST4, the result of the determination processing in step S107 is YES, and thus the process advances to step S108. On the other hand, if the printing elements to be used are changed as shown in ST5, the result of the determination processing in step S107 is NO, and thus the process advances to step S109. That is, it is possible to change the result of the determination processing in step S107 of FIG. 9 toward the processing (step S113) of performing skew correction while keeping the overlap state by changing the printing elements to be used, as shown in ST5, and controlling the conveyance amount in accordance with the changed printing elements.

Figure 12:
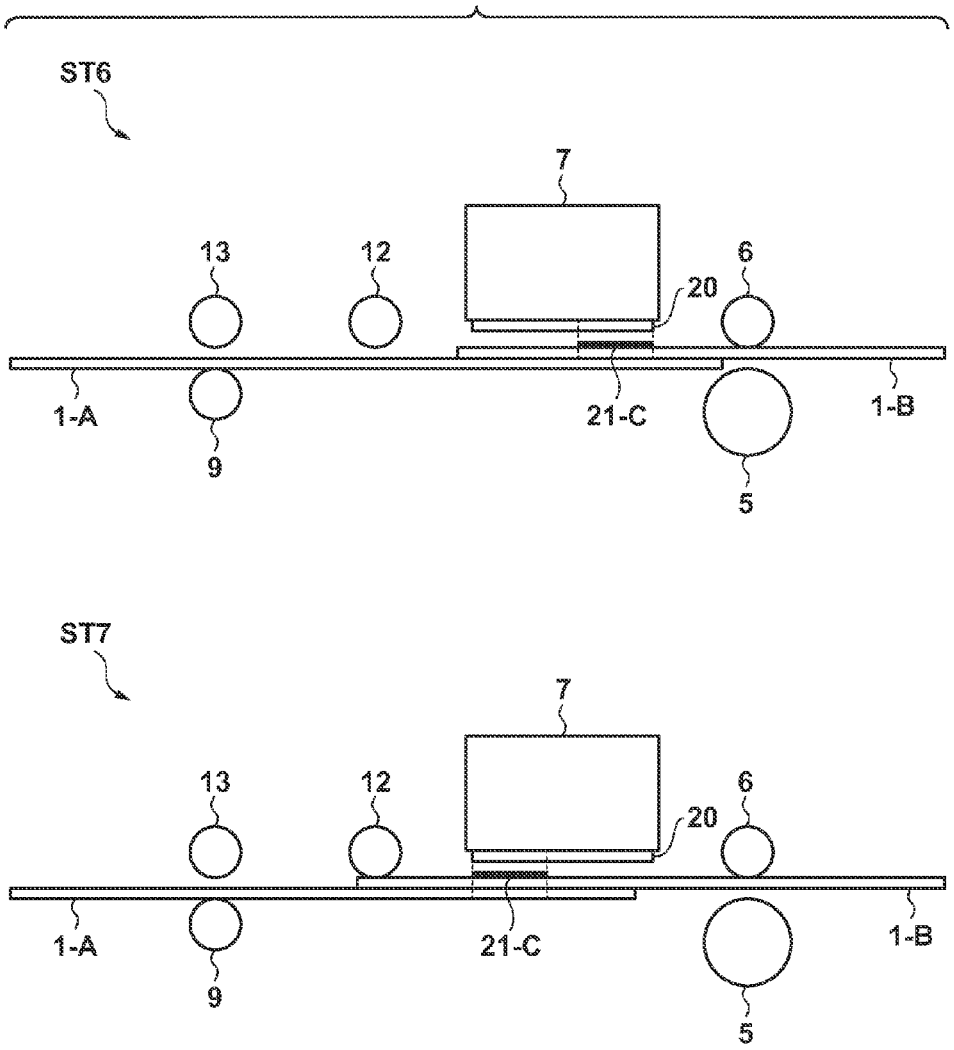
FIG. 12 is a view for explaining the printing operation and the state of the printing apparatus when the printing elements to be used are changed according to the embodiment.

FIG. 12 is a view showing the state of the printing apparatus at the time of the image forming operation of the first row of the succeeding sheet 1-B when the printing elements to be used are changed so as to change the determination result of the determination processing in step S109 of FIG. 9.

Referring to FIG. 12, ST6 shows the state of the printing apparatus when the printing elements to be used remain unchanged in the image forming operation of the first row of the succeeding sheet 1-B, and ST7 shows the state of the printing apparatus when the printing elements to be used are changed. In the example shown in ST6, conveyance is controlled to form an image 21-C using printing elements on the more upstream side of the sheet conveyance direction among the printing elements 20. In the example shown in ST6, it is determined that the leading edge of the succeeding sheet 1-B has not reached the pressing spur (NO in step S109 of FIG. 9). Therefore, the overlap state of the sheets is canceled, and a skew correction operation for only the succeeding sheet is performed (step S110 of FIG. 9).

In ST7, the state of the printing apparatus at the time of performing the image forming operation of the first row of the succeeding sheet 1-B by changing the printing elements to be used with respect to ST6 is shown. In this example, conveyance is controlled to form the image 21-C using printing elements on the more downstream side of the sheet conveyance direction among the printing elements 20. In the image forming operation of the first row of the succeeding sheet, if it is determined that the leading edge of the succeeding sheet is not conveyed to a predetermined position (the pressing spur 12), the printing elements of the printing unit are controlled to change the use of the printing elements arranged at positions (upstream of the sheet conveyance direction) close to the trailing edge of the succeeding sheet to the use of the printing elements arranged at positions (downstream of the sheet conveyance direction) close to the leading edge of the succeeding sheet. The conveyance amount is also controlled according to the change of the printing elements to be used.

In the state shown in ST7, a printing operation starts after the sheets are conveyed by a long distance as compared with the case shown in ST6. Therefore, it is determined that the leading edge of the succeeding sheet 1-B has reached the pressing spur (YES in step S109 of FIG. 9). That is, it is possible to change the result of the determination processing in step S109 of FIG. 9 toward the processing (step S113) of performing skew correction while keeping the overlap state by changing the printing elements to be used, as shown in ST7, and controlling the conveyance amount in accordance with the changed printing elements.

Figure 13:
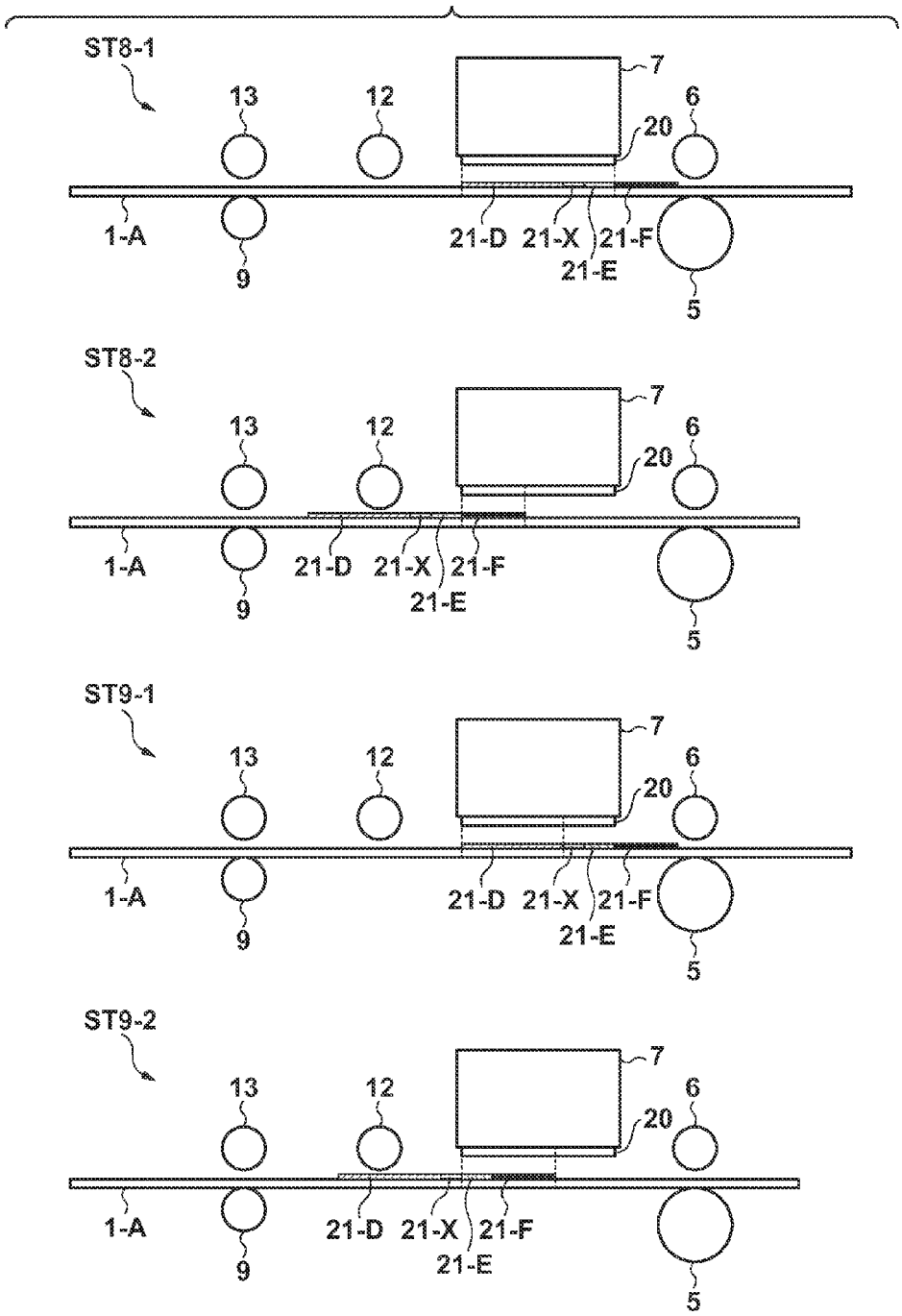
FIG. 13 is a view for explaining the printing operation and the state of the printing apparatus when the printing elements to be used are changed according to the embodiment.

FIG. 13 is a view showing the state of the printing apparatus at the time of the image forming operation of the last row of the preceding sheet 1-A when the printing elements to be used are changed so as to change the determination result of the determination processing in step S111 of FIG. 9.

Referring to FIG. 13, each of ST8-1 and ST8-2 shows the state of the printing apparatus when the printing elements to be used remain unchanged. In ST8-1, the state of the printing apparatus at the time of the image forming operation of a row immediately preceding the last row of the preceding sheet 1-A is shown. In ST8-2, the state of the printing apparatus at the time of the image forming operation of the last row of the preceding sheet 1-A is shown. In ST8-1 and ST8-2, image forming operations as many as possible are performed by one printing operation. In ST8-1 in which the image forming operation of the row immediately preceding the last row is performed, images 21-D and 21-E including a blank 21-X are simultaneously formed by one printing operation.

An image 21-F is to be formed on the next row (last row), and is not printed yet upon completion of the printing operation in ST8-1. In ST8-2, the image 21-F is formed on the last row. At this time, since there is no blank between the images 21-F and 21-E, it is determined that there is no gap between the last row and the immediately preceding row (NO in step S111 of FIG. 9). Therefore, in the determination processing in step S111 of FIG. 9, the overlap state is canceled and skew correction is performed (step S112 of FIG. 9).

Referring to FIG. 13, each of ST9-1 and ST9-2 shows an example of the state of the printing apparatus when printing is executed by changing the printing elements to be used. In the examples shown in ST9-1 and ST9-2, the printing elements to be used are controlled to divide a printing operation at the position of a blank to the extent that the printing operation count of the last row is not influenced.

In ST9-1 in which printing is executed for the row immediately preceding the last row, only the image 21-D on the leading edge side with respect to the blank 21-X is formed. Upon completion of the printing operation in ST9-1, the images 21-E and 21-F are not printed yet. In ST8-1 described above, the blank 21-X and the image 21-E are formed together with the image 21-D. In ST9-1, the printing elements to be used are controlled to separately print the image 21-D, blank 21-X, and image 21-E.

In ST9-2, the images 21-E and 21-F are simultaneously formed by the printing operation of the last row. In ST9-1 and ST9-2 of FIG. 13, since there is the blank 21-X between the image 21-D formed on the immediately preceding row and the images 21-E and 21-F, it is determined that there is a gap between the last row and the immediately preceding row (YES in step S111 of FIG. 9). Then, skew correction is performed while keeping the overlap state (step S113 of FIG. 9).

Figure 14:
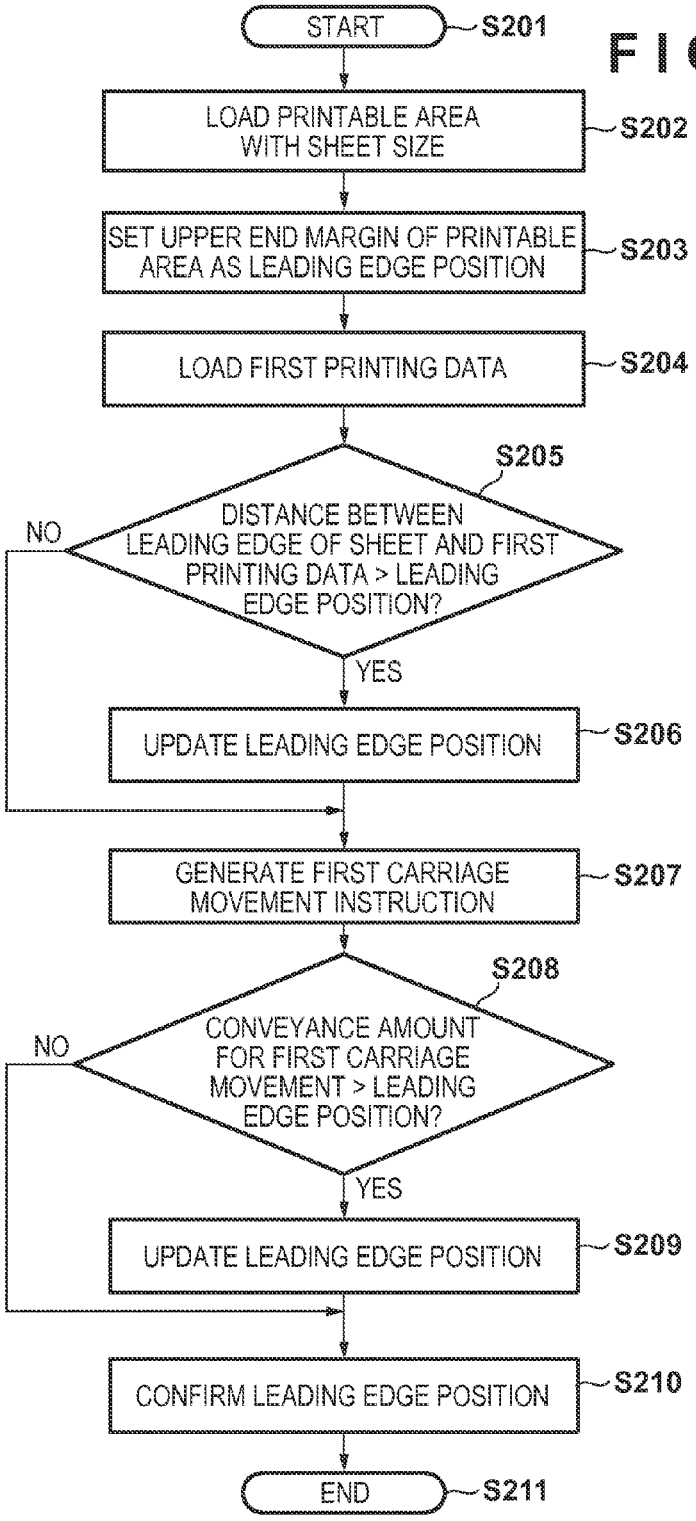
FIG. 14 is a flowchart for explaining an operation of calculating the leading edge position of the succeeding sheet.

FIG. 14 is a flowchart for explaining an arrangement of calculating the leading edge position of the succeeding sheet after alignment of the succeeding sheet according to this embodiment.

In step S201, the process starts. In step S202, a printable area with a sheet size is loaded. Since the uppermost printable position, that is, the upper end margin is specified, the upper end margin of the printable area is set as a leading edge position (step S203). Note that the leading edge position is defined by the distance from the conveyance nip portion.

The first printing data is loaded (step S204). With this processing, the position of the first printing data from the leading edge of the sheet is specified (detection of a non-printing area), and thus it is determined whether the distance between the leading edge of the sheet and the first printing data is larger than the previously set leading edge position (step S205). If the distance between the leading edge of the sheet and the first printing data is larger than the previously set leading edge position (YES in step S205), the leading edge position is updated by the distance between the leading edge of the sheet and the first printing data (step S206). If the distance between the leading edge of the sheet and the first printing data is equal to or smaller than the previously set leading edge position (NO in step S205), the process advances to step S207.

Next, the first carriage movement instruction is generated (step S207). It is determined whether a sheet conveyance amount for the first carriage movement is larger than the previously set leading edge position (step S208). If the sheet conveyance amount for the first carriage movement is larger than the previously set leading edge position (YES in step S208), the leading edge position is updated by the sheet conveyance amount for the first carriage movement (step S209). If the sheet conveyance amount for the first carriage movement is equal to or smaller than the previously set leading edge position (NO in step S208), the leading edge position is not updated. In this manner, the leading edge position of the succeeding sheet 1-B is confirmed (step S210), and the process ends (step S211). Based on the confirmed leading edge position, it is possible to determine (step S109 of FIG. 9) whether the succeeding sheet 1-B reaches the pressing spur 12 when performing alignment of the succeeding sheet B.

As described above, according to the above embodiment, by determining whether to convey the succeeding sheet to the position facing the printhead 7 while keeping the overlap state when the leading edge of the succeeding sheet 1-B is made to overlap the trailing edge of the preceding sheet 1-A, it is possible to start to feed the succeeding sheet even if the marginal amount of the trailing edge of the preceding sheet 1-A and that of the leading edge of the succeeding sheet are not confirmed.

When performing the printing operation of the preceding sheet 1-A by the printhead 7, the feeding motor 206 is driven in synchronization with the conveyance motor 205 before the sheet detection sensor 16 detects the leading edge of the succeeding sheet 1-B, and the feeding motor 206 is continuously driven after the sheet detection sensor 16 detects the leading edge of the succeeding sheet, thereby making it possible to perform a chasing operation to make the succeeding sheet overlap the preceding sheet.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-135170, filed Jun. 30, 2014, which is hereby incorporated by reference herein in its entirety.

What is claimed is:

1. A printing apparatus comprising:

a feeding roller configured to feed a printing sheet;

a conveyance roller configured to convey the printing sheet fed by the feeding roller;

a printing unit having a plurality of printing elements arranged in a conveyance direction of the printing sheet and configured to perform a printing operation on the printing sheet conveyed by the conveyance roller;

a determination unit configured to perform a determination operation to determine whether or not a predetermined condition is satisfied;

a conveyance control unit configured to control conveyance of printing sheets so that an overlap state, in which a trailing edge of a preceding sheet as a printing sheet precedingly fed by the feeding roller and a leading edge of a succeeding sheet as a printing sheet succeedingly fed by the feeding roller overlap each other, is formed between the feeding roller and the conveyance roller, wherein the conveyance control unit is further configured to control conveyance of printing sheets, so as to, in a case where it is determined that the predetermined condition is satisfied, convey the succeeding sheet to a position facing the printing unit while keeping the overlap state and, in a case where it is determined that the predetermined condition is not satisfied, convey the succeeding sheet to the position in a state in which the overlap state is cancelled; and a printing control unit configured to set said determination unit, printing elements of the printing unit to be used in the printing operation so as to satisfy the predetermined condition in the determination operation.

2. The apparatus according to claim 1, wherein if the determination unit determines that the predetermined condition is not satisfied, the printing control unit sets the printing elements to be used in the printing operation so as to satisfy the predetermined condition.

3. The apparatus according to claim 1, wherein the predetermined condition is that the trailing edge of the preceding sheet has not passed through the conveyance roller when performing the printing operation of a last row on the preceding sheet, and the printing control unit sets the printing elements to be used in the printing operation to printing elements on an upstream side of the conveyance direction so as to satisfy the predetermined condition.

4. The apparatus according to claim 1, wherein the predetermined condition is that an overlap amount of the preceding sheet and the succeeding sheet is not smaller than a threshold, and the printing control unit sets the printing elements to be used in the printing operation to printing elements on the upstream side of the conveyance direction so as to satisfy the predetermined condition.

5. The apparatus according to claim 1, wherein the predetermined condition is that the leading edge of the succeeding sheet is conveyed to a predetermined position when performing the printing operation of a first row of the succeeding sheet, and the printing control unit sets the printing elements to be used in the printing operation to printing elements on the downstream side of the conveyance direction so as to satisfy the predetermined condition.

6. The apparatus according to claim 1, wherein the predetermined condition is that there is a gap between a last row of the preceding sheet and a row immediately preceding the last row, and the printing control unit sets the printing elements to be used so as to divide a printing operation at a position of a blank included in image forming of the preceding sheet.

7. The apparatus according to claim 1, wherein if the printing control unit sets the printing elements to be used in the printing operation, the conveyance control unit controls a conveyance amount of the printing sheet in accordance with the printing elements set by the printing control unit.

8. The apparatus according to claim 1, wherein the printing unit is configured to perform the printing operation by using the printing elements on a downstream side of the conveyance direction in the printing operation on a trailing edge side of the preceding sheet.

9. The apparatus according to claim 1, wherein the printing unit is configured to perform the printing operation by using the printing elements on an upstream side of the conveyance direction in the printing operation on a leading edge side of the succeeding sheet.

10. A method of controlling a printing apparatus including a feeding roller configured to feed a printing sheet, a conveyance roller configured to convey the printing sheet fed by the feeding roller unit, and a printing unit having a plurality of printing elements arranged in a conveyance direction of the printing sheet and configured to perform a printing operation on the printing sheet conveyed by the conveyance roller, the method comprising:

a determination step of performing a determination operation to determine whether or not a predetermined condition is satisfied;

a first conveyance control step of controlling conveyance of printing sheets so that an overlap state, in which a trailing edge of a preceding sheet as a printing sheet precedingly fed by the feeding roller and a leading edge of a succeeding sheet as a printing sheet succeedingly fed by the feeding roller overlap each other, is formed between the feeding roller and the conveyance roller;

a second conveyance control step of controlling conveyance of a printing sheets so as to, in a case where it is determined that the predetermined condition is satisfied, convey the succeeding sheet to a position facing the printing unit while keeping the overlap state, and, in a case where it is determined that the predetermined condition is not satisfied, convey the succeeding sheet to the position in a state in which the overlap state is cancelled; and a printing control step of setting printing elements of the printing unit to be used in the printing operation so as to satisfy the predetermined condition in the determination operation.

11. The method according to claim 10, wherein if it is determined in the determination step that the predetermined condition is not satisfied, the printing elements to be used in the printing operation are set so as to satisfy the predetermined condition in the printing control step.

12. A non-transitory computer-readable storage medium storing a program for causing a computer to execute each step of a method of controlling a printing apparatus including a feeding roller configured to feed a printing sheet, a conveyance roller configured to convey the printing sheet fed by the feeding roller, and a printing unit having a plurality of printing elements arranged in a conveyance direction of the printing sheet and configured to perform a printing operation on the printing sheet conveyed by the conveyance roller, the method comprising:

a determination step of performing a determination operation to determine whether or not a predetermined condition is satisfied;

a first conveyance control step of controlling conveyance of printing sheets so that an overlap state, in which a trailing edge of a preceding sheet as a printing sheet precedingly fed by the feeding roller and a leading edge of a succeeding sheet as a printing sheet succeedingly fed by the feeding roller overlap each other, is formed between the feeding roller and the conveyance roller;

a second conveyance control step of controlling conveyance of printing sheets so as to, in a case where it is determined that the predetermined condition is satisfied, convey the succeeding sheet to a position facing the printing unit while keeping the overlap state, and, in a case where it is determined that the predetermined condition is not satisfied, convey the succeeding sheet to the position in a state in which the overlap state is cancelled; and a printing control step of setting printing elements of the printing unit to be used in the printing operation so as to satisfy the predetermined condition in the determination operation.

* * * * *